US008617461B2

(12) United States Patent
Yamada et al.

(10) Patent No.: US 8,617,461 B2
(45) Date of Patent: Dec. 31, 2013

(54) CONTINUOUS GAS CARBURIZING FURNACE

(75) Inventors: Masahiro Yamada, Toyota (JP); Osamu Ooshita, Osaka (JP); Kazunori Tooyama, Sakai (JP); Yuki Kono, Osaka (JP)

(73) Assignees: Toyota Jidosha Kabushiki Kaisha, Toyota-shi, Aichi-ken (JP); Chugai Ro Co., Ltd., Osaka (JP)

( * ) Notice: Subject to any disclaimer, the term of this patent is extended or adjusted under 35 U.S.C. 154(b) by 0 days.

(21) Appl. No.: 13/638,109

(22) PCT Filed: Mar. 28, 2011

(86) PCT No.: PCT/IB2011/001158
§ 371 (c)(1),
(2), (4) Date: Sep. 28, 2012

(87) PCT Pub. No.: WO2011/121451
PCT Pub. Date: Oct. 6, 2011

(65) Prior Publication Data

US 2013/0019796 A1 Jan. 24, 2013

(30) Foreign Application Priority Data

Mar. 29, 2010 (JP) ..... 2010-074918

(51) Int. Cl.
*B05C 11/00* (2006.01)

(52) U.S. Cl.
USPC ..... 266/252; 266/103; 432/128

(58) Field of Classification Search
USPC ..... 266/252, 103; 432/128
See application file for complete search history.

(56) References Cited

U.S. PATENT DOCUMENTS 4,836,864 A * 6/1989 Murakami et al. ..... 148/223
5,624,255 A 4/1997 Hisada et al.

(Continued)

FOREIGN PATENT DOCUMENTS

EP 0 147 845 A 7/1985
JP 60-138065 7/1985

(Continued)

OTHER PUBLICATIONS

"In-line Heat Treatment Equipment 'ICBP'", http://www.pnk.co.jp/report/pdf/perker_isbc.pdf, dated Mar. 14, 2011.

(Continued)

*Primary Examiner* — Scott Kastler
(74) *Attorney, Agent, or Firm* — Finnegan, Henderson, Farabow, Garrett & Dunner, LLP

(57) ABSTRACT

A continuous gas carburizing furnace includes a gas carburizing processing chamber (a preheating chamber 2, a heating chamber 3, a carburizing chamber 4, a diffusion chamber 5 and a temperature decrease chamber 6) in which a gas carburizing process is performed on a workpiece 50, an oil quenching chamber 8 in which oil quenching is performed on the workpiece 50, and a gas quenching chamber 7 in which gas quenching is performed on the workpiece 50. The gas carburizing processing chamber includes a temperature decrease chamber 6 in which the temperature of the workpiece heated by a gas carburizing process is lowered. The temperature decrease chamber 6, the gas quenching chamber 7 and the oil quenching chamber 8 are arranged in that order from the upstream side to the downstream side in the conveying direction of the workpiece 50, and are adjacent to each other.

6 Claims, 12 Drawing Sheets

(56) References Cited

U.S. PATENT DOCUMENTS

| | | | | |
|---|---|---|---|---|
| 7,090,488 | B2 * | 8/2006 | Murakami et al. | 432/128 |
| 2010/0068669 | A1 | 3/2010 | Ishimoto et al. | |
| 2013/0019796 | A1 * | 1/2013 | Yamada et al. | 118/47 |

FOREIGN PATENT DOCUMENTS

| | | |
|---|---|---|
| JP | 61-27485 | 2/1986 |
| JP | 6-137765 | 5/1994 |
| JP | 6-158267 | 6/1994 |
| JP | 6-174377 | 6/1994 |
| JP | 2002-146512 | 5/2002 |
| JP | 2003-343981 | 12/2003 |
| JP | 2005-344183 | 12/2005 |
| KR | 10-2010-0032827 | 3/2010 |

OTHER PUBLICATIONS

Written Opinion of the International Searching Authority in PCT/IB2011/001158; Mailing Date: Jul. 21, 2011.
Applicant's Response in PCT/IB2011/001158 (Jan. 25, 2012).
Notification of Reason(s) for Refusal in Japanese patent Application No. 2010-074918; Drafting Date: Feb. 29, 2012.

* cited by examiner

CONTINUOUS GAS CARBURIZING FURNACE

CROSS-REFERENCE TO RELATED APPLICATIONS

This application is a national phase application of International Application No. PCT/IB2011/001158, filed Mar. 28, 2011, and claims the priority of Japanese Application No. 2010-074918, filed Mar. 29, 2010, the content of both of which is incorporated herein by reference.

BACKGROUND OF THE INVENTION

1. Field of the Invention

The invention relates to a technology of a continuous gas carburizing furnace capable of arbitrary selection between gas quenching and oil quenching.

2. Description of the Related Art

A known method of surface hardening performed on a steal material (hereinafter, termed "workpiece") according to the related art is a carburizing process. The carburizing process is a method in which a surface of a workpiece is infiltrated with carbon (carburized) and the carbon in the surface is diffused so as to increase the amount of carbon in the surface, and then quenching is performed so as to improve the abrasion resistance of the workpiece's surface while securing toughness of the workpiece.

Among the carburizing processes, a gas carburizing method that uses a carburizing gas (CO gas) as a carburizing agent is known. In fact, a carburizing process that uses a continuous gas carburizing furnace is often employed because, among other reasons, this method is able to carburize a large quantity of workpieces at a time.

With reference to FIG. 10, an example of the continuous gas carburizing furnaces according to the related art will be described. FIG. 10 is a side sectional view showing an overall construction of a continuous gas carburizing furnace 101. For the following description, it is to be noted that the direction of an arrow A in FIG. 10 shows the conveying direction of workpieces 50, and defines the forward direction of the continuous gas carburizing furnace 101.

The continuous gas carburizing furnace 101 is made up mainly of a degreasing chamber 102, a preheating chamber 103, a carburizing chamber 104, a diffusion chamber 105, a temperature decrease chamber 106, an oil quenching chamber 107, etc. These chambers 102, 103, . . . , 107 are contiguously arranged in a line along the conveying direction of the workpiece 50 (the direction of the arrow A in FIG. 10). Then, the gas carburizing process is performed on the workpiece 50 by the following series of operation processes: (1) a grease or the like adhering to a surface of a workpiece 50 is removed therefrom in the degreasing chamber 102; (2) the temperature of the workpiece 50 is increased in the preheating chamber 103 to a temperature suitable for the gas carburizing process; (3) a carburizing gas (CO gas) is blown to the surface of the workpiece 50 in the carburizing chamber 104, so that carbon is infiltrated into the workpiece 50 from its surface; (4) the workpiece 50 is kept at a predetermined temperature in the diffusion chamber 105, so that the carbon (atoms) infiltrated in the workpiece 50 diffuses; (5) the temperature of the workpiece 50 is decreased in the temperature decrease chamber 106 to a temperature suitable to quenching; and (6) the workpiece 50 is placed into the oil quenching chamber 107, so that the quenching process is performed on the workpiece 50.

In the foregoing continuous gas carburizing furnace 101, the workpiece 50 is continuously conveyed by a conveying device made up of a roller conveyor or the like which is disposed inside the furnace, so that the gas carburizing process is performed as the workpiece 50 passes through the chambers 102, 103, . . . , 107 in that order. Therefore, it becomes possible to continuously process a plurality of workpieces 50, and thus high productivity can be achieved.

Incidentally, as for the quenching process performed after the surface of the workpiece is infiltrated with carbon (carburized) and the carbon in the surface is diffused, gas quenching as well as the foregoing oil quenching is known, and the two quenching processes have different characteristics. That is, in the oil quenching, many workpieces are submerged directly into an oil tank at a time, so that productivity is high. However, since the workpieces are rapidly cooled in a short time, local distortion is likely to occur, and high precision quality (product accuracy) is difficult to secure. On the other hand, in the gas quenching, workpieces are cooled by a gas, that is, an inert gas (nitrogen gas), so that a longer cooling time is required than in the oil quenching, and therefore lower productivity results. However, since workpieces are cooled gradually as a whole, local distortion is unlikely to occur, and high precision quality (product accuracy) can be secured.

Comparison in the product accuracy of workpieces between the oil quenching and the gas quenching will be described with reference to FIGS. 11A and 11B. FIGS. 11A and 11B are bar charts showing comparison between the oil quenching and the gas quenching in terms of the product accuracy of gears (toothed wheels) as an example of workpieces. The chart of FIG. 11A shows the shape accuracy, and the chart of FIG. 11B shows the tooth surface accuracy. Incidentally, the "shape accuracy" refers to the post-quench amount of eccentricity of the external shape of an entire gear relative to the pre-quench amount thereof. Besides, the "tooth surface accuracy" refers to the post-quench amount of distortion of the shape of each gear tooth surface relative to the pre-quench amount thereof.

In FIG. 11A, the vertical axis shows the "shape accuracy", and higher values in the "shape accuracy" mean larger amounts of eccentricity of the entire external shape of the gear. That is, on the vertical axis, higher values in the "shape accuracy" indicate lower degrees of the shape accuracy, and lower values of the "shape accuracy" indicate higher degrees of the shape accuracy. Therefore, by comparison in the shape accuracy between the oil quenching and the gas quenching in the bar chart presented in the foregoing fashion, it is apparent that the bar of the gas quenching is smaller in value than the bar of the oil quenching, showing that the gas quenching is higher in the shape accuracy than the oil quenching.

In FIG. 11B, the vertical axis shows the "tooth surface accuracy", and higher values in the "tooth surface accuracy" mean larger amounts of distortion of the shape of each tooth surface of the gear. That is, on the vertical axis, higher values in the "tooth surface accuracy" indicate lower degrees of the tooth surface accuracy, and lower values in the "tooth surface accuracy" indicate higher degrees of the tooth surface accuracy. Therefore, by comparison in the tooth surface accuracy between the oil quenching and the gas quenching in the bar chart presented in the foregoing fashion, it is apparent that the bar of the gas quenching is smaller in value than the bar of the oil quenching, showing that the gas quenching is higher in the tooth surface accuracy than the oil quenching.

In conjunction with the oil quenching and the gas quenching having different characteristics as described above, a carburizing furnace capable of arbitrary selection of either one of the quenching processes is desired in recent years in order to meet all the needs regarding the production conditions for workpieces. Then, to realize such a carburizing furnace, various technologies have been proposed, including a technology in which the entire conveying path is vacuum-tightly sealed, and is disposed at a center of the furnace equipment, and a plurality of processing chambers provided as independent cells separate for each process step are disposed along the conveying path (see Japanese Patent Application Publication No. 6-137765 (JP-A-6-137765)), a technology in which a carriage that moves on the conveying path is provided with a vacuum-tightly sealed conveying chamber, and the conveying chamber is used for transfer of works (workpieces) between a plurality of processing chambers provided as cells (see Japanese Patent Application Publication No. 6-174377 (JP-A-6-174377)), etc.

An example of the cell-type carburizing furnace will be described. As an example of a reduced-pressure type carburizing furnace, more specifically, a cell-type reduced-pressure carburizing furnace 201 shown in FIG. 12A is constructed of a vacuum conveying chamber 202 disposed at a center, a plurality of cells 203, 204, . . . , 206 that are provided separately for each process step and that are arranged along the vacuum conveying chamber 202, etc. The cells 203, 204, . . . , 206 are each constructed as an independent cell structure, for example, heating cells 203, carburizing cells 204, . . . , a gas quenching cell 205, an oil quenching cell 206, etc. The oil quenching cell 206 is connected at a side thereof to the vacuum conveying chamber 202, and at another side to a conveyor 207 that conveys workpieces into and out of the furnace.

To perform the carburizing process on a workpiece, the workpiece conveyed by the conveyor 207 firstly passes through the oil quenching cell 206, and is conveyed to one of the heating cells 203 via the inside of the vacuum conveying chamber 202 (as shown by an arrow 1 in FIG. 12A). After being heated in the heating cell 203, the workpiece is conveyed to one of the carburizing cells 204 via the inside of the vacuum conveying chamber 202 (as shown by an arrow 2 in FIG. 12A). After being carburized in the carburizing cell 204, the workpiece is conveyed to the gas quenching cell 205 via the inside of the vacuum conveying chamber 202 (as shown by an arrow 3 in FIG. 12A). After being quenched in the gas quenching cell 205, the workpiece is conveyed via the inside of the vacuum conveying chamber 202, and passes through the oil quenching cell 206 again, and then is sent to the conveyor 207 (as shown by an arrow 4 in FIG. 12A). Incidentally, in the case where the oil quenching is performed after the carburizing process, the workpiece is oil-quenched when the workpiece is conveyed to the oil quenching cell 206 after being conveyed from one of the carburizing cells 204.

The use of the foregoing cell-type reduced-pressure carburizing furnace 201 makes it possible to arbitrarily select either one of the oil quenching and the gas quenching for use in the quenching process of a workpiece that is performed after a surface of the workpiece has been infiltrated with carbon (carburized) and the carbon in the surface has been diffused, so as to meet all the needs related to the production conditions for the workpiece. However, due to the layout of the furnace equipment, the cells 203, 204, . . . , 206 are rather sparsely located along the vacuum conveying chamber 202, so that a long moving time from one cell to another is required. Therefore, since the movement or conveyance from the carburizing cell 204 to the gas quenching cell 205 (or the oil quenching cell 206) requires a relatively long time, the temperature of the workpiece drops during the conveyance, so that the carburization hardening depth and the product accuracy vary greatly. Besides, in order to minimize the variations of the workpieces in the carburization hardening depth and the product accuracy, it becomes necessary to shorten the moving distance from one cell to another, which naturally limits the number of cells 203, 204, . . . , 206 that can be installed. As a result, the productivity of the cell-type reduced-pressure carburizing furnace 201 as a whole is rather low.

On the other hand, the vacuum conveying chamber 202 that extends connecting the cells 203, 204, . . . , 206 is large in size, and it is necessary to dispose a plurality of cell-type reduced-pressure carburizing furnaces 201, in order to secure a larger number of workpieces produced (the total number of workpieces that can be carburized by the cell-type reduced-pressure carburizing furnace 201 in a fixed amount of time). Therefore, a large installation space is needed, and the equipment-occupied area (i.e., the area of an installation space for one workpiece becomes large, so that the equipment cost increases.

Furthermore, in the vacuum conveying chamber 202, the flow lines (shown by the arrows 1 to 5 in FIG. 12A) representing the movements from one cell to another is complicated and intertangled, so that a complicated construction of the conveying mechanism results. Besides, since the inside of the cell-type reduced-pressure carburizing furnace 201 as a whole needs to be kept in a substantially vacuum state. Thus, the equipment as a whole needs to be constructed so as to have both good air tightness and good pressure resistance. Thus, the equipment cost increases.

There also exists a cell-type reduced-pressure carburizing furnace 301 as shown in FIG. 12B that is different from the foregoing carburizing furnace 201 despite of being of the reduced-pressure type as well. The cell-type reduced-pressure carburizing furnace 301 is constructed so that the processes from heating to cooling can be carried out in each of a plurality of independent cell chambers 302 and is constructed of a conveying path 303, and the plurality of cell chamber 302 disposed along the conveying direction of the conveying path 303. On the conveying path 303, a movable gas quenching chamber 305 having a conveying device 304 and a movable oil quenching chamber 306 having a conveying device 304 are provided independently of each other. In this construction, a workpiece is carburized as the workpiece is moved between the cell chambers 302 and the gas quenching chamber 305, or between the cell chambers 302 and the oil quenching chamber 306.

This cell-type reduced-pressure carburizing furnace 301 makes it possible to arbitrarily select either one of the oil quenching and the gas quenching for use in the quenching process of a workpiece that is performed after a surface of the workpiece has been infiltrated with carbon (carburized) and the carbon in the surface has been diffused, so as to meet all the needs related to the production conditions for workpieces. Besides, the gas quenching chamber 305 and the oil quenching chamber 306 provided independently of each other are each provided with a temperature keeping device, a vacuum pump, etc., so that, unlike the foregoing cell-type reduced-pressure carburizing furnace 201, temperature fall of a workpiece does not occur during the conveyance of workpieces. Therefore, there is no need to shorten the moving distance from one cell to another, so that the number of cell chambers 302 that can be installed will not be inconveniently limited.

However, the conveying devices 304, which each convey the gas quenching chamber 305 or the oil quenching chamber 306 independently from each other, have a long and large construction, and also have a complicated structure. Therefore, the equipment cost increases.

Besides, since the conveying devices 304 have a large conveying space, the installation space of the cell-type reduced-pressure carburizing furnace 31 is also large. Therefore, the equipment occupied area (i.e., the area of the installation space per workpiece) becomes large, so that the equipment cost increases.

Besides, in the case, for example, where a workpiece is moved between the gas quenching chamber 305 (or the oil quenching chamber 306) and the cell chambers 302, a substantially vacuum state needs to be maintained in each conveying device 304. An apparatus for creating such a vacuum state requires a complicated construction, which makes it difficult to secure reliability of the furnace equipment as a whole.

Furthermore, since the conveying devices 304, which each convey the gas quenching chamber 305 or the oil quenching chamber 306 independently of each other, have a long and large construction, the conveying speed of the conveying devices 304 is restrained to a low speed. Besides, since the cell chambers 302 are juxtaposed along the conveying path 303, the distance between two cell chambers 302 can be very long in some cases. In such a case, the moving time of the gas quenching chamber 305 or the oil quenching chamber 306 is long, so that a large amount of heat for keeping the temperature of workpieces is consumed in order to restrain variations of the product accuracy, resulting in increased running cost.

SUMMARY OF THE INVENTION

The invention provides a continuous gas carburizing furnace that is capable of arbitrary selection between gas quenching and oil quenching, and that requires only a small installation space, and does not require a large amount of equipment cost, and achieves high productivity, and has a simple construction, and that has high reliability as the entire equipment.

One aspect of the invention a continuous gas carburizing furnace in which a plurality of steps are serially arranged in a line along a conveying direction of a workpiece. This continuous gas carburizing furnace includes: a gas carburizing processing chamber in which a gas carburizing process is performed on the workpiece; an oil quenching chamber in which oil quenching is performed on the workpiece; and a gas quenching chamber in which gas quenching is performed on the workpiece. The gas carburizing processing chamber includes a temperature decrease chamber that lowers temperature of the workpiece that is heated by a gas carburizing process. The temperature decrease chamber, the gas quenching chamber and the oil quenching chamber are arranged sequentially in that order of mention from an upstream side to a downstream side in the conveying direction of the workpiece, and are adjacent to each other.

In the continuous gas carburizing furnace according to this aspect of the invention, a first conveying chamber that covers a side surface portion of the temperature decrease chamber and a side surface portion of the gas quenching chamber which face each other may be provided between the temperature decrease chamber and the gas quenching chamber, and a second conveying chamber that covers a side surface portion of the gas quenching chamber and a side surface portion of the oil quenching chamber which face each other may be provided between the gas quenching chamber and the oil quenching chamber, and inside the first conveying chamber, a first open-close door for thermal insulation may be provided for the side surface portion of the temperature decrease chamber which faces the gas quenching portion, and inside the first conveying chamber, a second open-close door for pressure resistance may be provided for the side surface of the gas quenching chamber which faces the temperature decrease chamber, and inside the second conveying chamber, a third open-close door for pressure resistance may be provided for the side surface portion of the gas quenching chamber which faces the oil quenching chamber, and inside the second conveying chamber, a fourth open-close door for oil vapor shielding may be provided for the side surface portion of the oil quenching chamber which faces the gas quenching chamber.

In the continuous gas carburizing furnace according to the foregoing aspect, a communication pathway that provides communication between the first conveying chamber and the second conveying chamber may be provided between the first conveying chamber and the second conveying chamber.

In the continuous gas carburizing furnace according to the foregoing aspect, the first open-close door may be provided with a plurality of hole portion, and a carburizing gas may flow from the temperature decrease chamber into the first conveying chamber through the plurality of hole portions.

In the continuous gas carburizing furnace according to the foregoing aspect, the oil quenching chamber may be provided with a gas supply device that introduces a carburizing gas or a nitrogen gas into the oil quenching chamber.

In the continuous gas carburizing furnace according to the foregoing aspect, the temperature decrease chamber may be provided with a carburizing gas purge mechanism for restraining decline of CO (carbon monoxide) concentration in the temperature decrease chamber, and the carburizing gas purge mechanism may supply a carburizing gas into the temperature decrease chamber after an open-close door for pressure resistance provided for the side surface portion of the gas quenching chamber which faces the temperature decrease chamber is opened.

In the continuous gas carburizing furnace according to the foregoing aspect, when the workpiece is conveyed from the gas carburizing processing chamber to the gas quenching chamber, the first open-close door and the second open-close door may be opened and the third open-close door and the fourth open-close door may remain closed, and when the workpiece is conveyed from the gas quenching chamber to the oil quenching chamber, the third open-close door and the fourth open-close door may be opened and the first open-close door and the second open-close door may remain closed.

The invention achieves effects as stated below.

That is, according to the continuous gas carburizing furnace of the invention, it is possible to provide a continuous gas carburizing furnace that is capable of arbitrary selection between gas quenching and oil quenching and that requires only a small installation space, and does not require a large amount of equipment cost, and achieves high productivity, and has a simple construction, and that has high reliability as the entire equipment.

BRIEF DESCRIPTION OF THE DRAWINGS

The foregoing and further objects, features and advantages of the invention will become apparent from the following description of example embodiments with reference to the accompanying drawings, wherein like numerals are used to represent like elements and wherein:

FIG. 6A shows changes in the temperature of the workpiece in the diffusion chamber and the succeeding chambers, and FIG. 6B shows changes in the pressure in the diffusion chamber and the succeeding chambers;

FIG. 7A shows changes in the temperature of the workpiece in the diffusion chamber and the succeeding chambers, and FIG. 6B shows changes in the pressure in the diffusion chamber and the succeeding chambers;

FIG. 9A shows a flow of steps in a continuous gas carburizing furnace in the embodiment, and FIG. 9B shows flows of steps in a continuous gas carburizing furnace and a cell-type reduced-pressure carburizing furnace as comparative examples;

FIG. 11A shows the shape accuracy, and FIG. 11B shows the toothed accuracy; FIG. 12A shows a construction in which the individual steps are separated into different cells, and FIG. 12B shows a construction in which each one of a plurality of cells is provided with a function of performing a process from heating to cooling.

DETAILED DESCRIPTION OF EMBODIMENTS

An embodiment of the invention will be hereinafter described.

[Overall Construction of Continuous Gas Carburizing Furnace 1]

Figure 1:
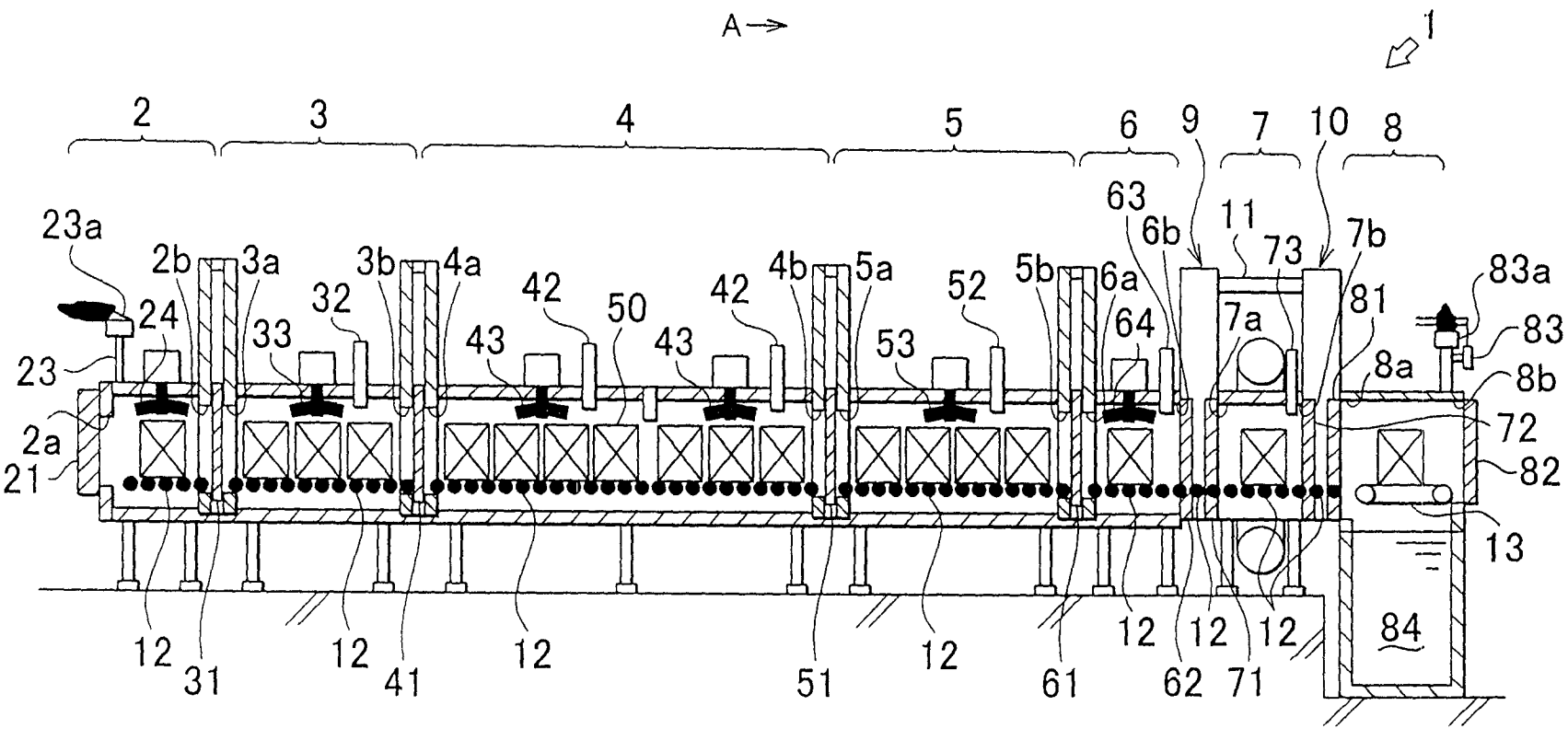
FIG. 1 is a side sectional view showing an overall construction of a continuous gas carburizing furnace according to an embodiment of the invention.

Firstly, an overall construction of a continuous gas carburizing furnace 1 in accordance with an embodiment of the invention will be described with reference to FIG. 1 Incidentally, for the following description, it is assumed that the direction of an arrow A in FIG. 1 shows the conveying direction of workpieces 50; and defines the forward direction of the continuous gas carburizing furnace 1.

The continuous gas carburizing furnace 1 has a preheating chamber 2, a heating chamber 3, a carburizing chamber 4, a diffusion chamber 5, temperature decrease chamber 6, a gas quenching chamber 7, an oil quenching chamber 8, a first conveying chamber 9 disposed between the temperature decrease chamber 6 and the gas quenching chamber 7, and a second conveying chamber 10 disposed between the gas quenching chamber 7 and the oil quenching chamber 8. These chambers are disposed along a conveying pathway (conveying direction) of workpieces 50. That is, in FIG. 1, the preheating chamber 2, the heating chamber 3, the carburizing chamber 4, the diffusion chamber 5, the temperature decrease chamber 6, the first conveying chamber 9, the gas quenching chamber 7, the second conveying chamber 10 and the oil quenching chamber 8 are linearly disposed in that order from the upstream side to the downstream side of the conveying pathway of the workpieces 50. Incidentally, the "workpieces 50" are machine component parts or the like that are made of a steel material and whose surfaces are subjected to a carburizing process in the continuous gas carburizing furnace 1 of this embodiment.

The preheating chamber 2 is a chamber for preliminarily heating the workpieces 50, and is disposed at the most upstream side in the conveying direction of the workpieces 50. Besides, an upstream-side wall portion of the preheating chamber 2 has a carry-in entrance 2*a* for conveying the workpieces 50 into an inside of the continuous gas carburizing furnace 1 (hereinafter, sometimes termed the furnace). A downstream-side wall portion of the preheating chamber 2 has an outlet portion 2*b* for conveying the workpieces 50 to the succeeding step.

The heating chamber 3 is a chamber for further heating the workpieces 50 that have been preliminarily heated by the preheating chamber 2, to a temperature suitable to the carburizing process. On the downstream side of the preheating chamber 2, the heating chamber 3 is adjacent to the preheating chamber 2. Besides, an upstream-side wall portion and a downstream-side wall portion of the heating chamber 3 have an inlet portion 3*a* and an outlet portion 3*b*, respectively. The heating chamber 3 communicates with the inside of the preheating chamber 2 via the inlet portion 3*a*, and communicates, via the outlet portion 3*b*, with the inside of the carburizing chamber 4, which is the succeeding-step chamber.

The carburizing chamber 4 is a chamber for performing a carburizing process by infiltrating carbon into surfaces of the workpieces 50 that have been heated by the heating chamber 3. On the downstream side of the heating chamber 3, the carburizing chamber 4 is adjacent to the heating chamber 3. Besides, an upstream-side wall portion and a downstream-side wall portion of the carburizing chamber 4 have an inlet portion 4*a* and an outlet portion 4*b*, respectively. The carburizing chamber 4 communicates with the inside of the heating chamber 3 via the inlet portion 4*a*, and communicates, via the outlet portion 4*b*, with the succeeding-step chamber, that is, the diffusion chamber 5.

The diffusion chamber 5 is a chamber for causing the carbon that is infiltrated in a surface of each workpiece 50 in the carburizing chamber 4 to diffuse into the interior of each workpiece 50. On the downstream side of the carburizing chamber 4, the diffusion chamber 5 is adjacent to the carburizing chamber 4. Besides, an upstream-side wall portion and a downstream-side wall portion of the diffusion chamber 5 have an inlet portion 5*a* and an outlet portion 5*b*, respectively. The diffusion chamber 5 communicates with the inside of the carburizing chamber 4 via the inlet portion 5*a*, and communicates, via the outlet portion 5*b*, with the inside of the succeeding-step chamber, that is, the temperature decrease chamber 6.

The temperature decrease chamber 6 is a chamber for lowering the temperature of each workpiece 50 so as to condition the surface structure of each workpiece 50 for the quenching process performed in the succeeding step. On the downstream side of the diffusion chamber 5, the temperature decrease chamber 6 is adjacent to the diffusion chamber 5. Besides, an upstream-side wall portion and a downstream-side wall portion of the temperature decrease chamber 6 have an inlet portion 6*a* and an outlet portion 6*b*, respectively. The temperature decrease chamber 6 communicates with the inside of the diffusion chamber 5 via the inlet portion 6*a*, and communicates, via the outlet portion 6*b*, with the first conveying chamber 9, which conveys the workpieces 50 into the gas quenching chamber 7.

The gas quenching chamber 7 is a chamber for performing the gas quenching on the workpieces 50. At the downstream side of the temperature decrease chamber 6, the gas quenching chamber 7 is disposed adjacent to the temperature decrease chamber 6 via the first conveying chamber 9. That is, the first conveying chamber 9 is provided between the temperature decrease chamber 6 and the gas quenching chamber 7, and an upstream-side wall portion and a downstream-side wall portion of the first conveying chamber 9 are disposed in contact with the temperature decrease chamber 6 and the gas quenching chamber 7, respectively.

Besides, an upstream-side wall portion and a downstream-side wall portion of the gas quenching chamber 7 have an inlet portion 7*a* and an outlet portion 7*b*, respectively. The gas quenching chamber 7 communicates with the inside of the first conveying chamber 9 via the inlet portion 7*a*, and communicates, via the outlet portion 7*b*, with the second conveying chamber 10, which conveys the workpieces 50 into the oil quenching chamber 8. That is, the first conveying chamber 9 is constructed so as to cover the outlet portion 6*b* of the temperature decrease chamber 6 and the inlet portion 7*a* of the gas quenching chamber 7 which are formed in their side surfaces that face each other across the first conveying chamber 9.

The oil quenching chamber 8 is a chamber for performing the oil quenching on the workpieces 50. At the downstream of the gas quenching chamber 7, the oil quenching chamber 8 is adjacent to the gas quenching chamber 7 via the second conveying chamber 10. That is, the second conveying chamber 10 is provided between the gas quenching chamber 7 and the oil quenching chamber 8, and an upstream-side wall portion and a downstream-side wall portion of the second conveying chamber 10 are disposed in contact with the gas quenching chamber 7 and the oil quenching chamber 8, respectively. Incidentally, a bottom portion of the inside of the oil quenching chamber 8 is provided with an oil tank 84 in which the workpieces 50 are submerged.

An upstream-side wall portion and a downstream-side wall portion of the oil quenching chamber 8 have an inlet portion 8*a* and a carry-out exit 8*b*, respectively. The oil quenching chamber 8 communicates with the second conveying chamber 10 via the inlet portion 8*a*, and is arranged so that the workpieces 50 are conveyed out of the continuous gas carburizing furnace 1 via the carry-out exit 8*b*. That is, the second conveying chamber 10 is constructed so as to cover the outlet portion 7*b* of the gas quenching chamber 7 and the inlet portion 8*a* of the oil quenching chamber 8 which are formed in their side surfaces that face with each other across the second conveying chamber 10.

A communication pathway 11 is provided between the first conveying chamber 9 and the second conveying chamber 10. Via the communication pathway 11, the inside of the first conveying chamber 9 and the inside of the second conveying chamber 10 are in a state of communication with each other. In this construction, a carburizing gas (CO gas) introduced from the temperature decrease chamber 6 into the first conveying chamber 9 is always supplied into the second conveying chamber 10 via the communication pathway 11, as described below.

In the continuous gas carburizing furnace 1 constructed as described above, first conveying devices 12 made up of roller conveyors or the like are provided inside the preheating chamber 2, the heating chamber 3, the carburizing chamber 4, the diffusion chamber 5, the temperature decrease chamber 6 and the gas quenching chamber 7 as well as the first conveying chamber 9 and the second conveying chamber 10. Besides, a second conveying device 13 made up of a chain conveyor or the like is provided inside the oil quenching chamber 8. By the first conveying devices 12 and the second conveying device 13, the workpieces 50 are conveyed inside the furnace sequentially from the preheating chamber 2 to the oil quenching chamber 8. Besides, the preheating chamber 2, the heating chamber 3, the carburizing chamber 4, the diffusion chamber 5 and the temperature decrease chamber 6 together constitute a gas carburizing processing chamber in which a gas carburizing process is performed on the workpieces 50.

The carry-in entrance 2*a* of the preheating chamber 2 and the carry-out exit 8*b* of the oil quenching chamber 8 are provided with open-close doors 21 and 82 that have a thermal insulation function. Besides, up-and-down doors 31, 41, 51 and 61 that have a thermal insulation function are provided between the outlet portion 2*b* of the preheating chamber 2 and the inlet portion 3*a* of the heating chamber 3, between the outlet portion 3*b* of the heating chamber 3 and the inlet portion 4*a* of the carburizing chamber 4, between the outlet portion 4*b* of the carburizing chamber 4 and the inlet portion 5*a* of the diffusion chamber 5, and between the outlet portion 5*b* of the diffusion chamber 5 and the inlet portion 6*a* of the temperature decrease chamber 6, respectively.

Besides, the outlet portion 6*b* of the temperature decrease chamber 6 is provided with an up-and-down door 62 that has a thermal insulation function. The inlet portion 7*a* and the outlet portion 7*b* of the gas quenching chamber 7 are provided with up-and-down doors 71 and 72, respectively, that have a pressure resistance function. The inlet portion 8*a* of the oil quenching chamber 8 is provided with an up-and-down door 81 that has an oil resistance and shut-off function.

That is, inside the first conveying chamber 9, a side face portion close to the side (downstream side) of the temperature decrease chamber 6 which faces the gas quenching chamber 7 across the first conveying chamber 9 is provided with the thermally insulating up-and-down door 62, and a side face portion close to the side (upstream side) of the gas quenching chamber 7 which faces the temperature decrease chamber 6 across the first conveying chamber 9 is provided with the pressure-resisting up-and-down door 71. Besides, inside the second conveying chamber 10, a side face portion close to the side (downstream side) of the gas quenching chamber 7 which faces the oil quenching chamber 8 across the second conveying chamber 10 is provided with the pressure-resisting up-and-down door 72, and a side face portion close to the side (upstream side) of the oil quenching chamber 8 which faces the gas quenching chamber 7 across the second conveying chamber 10 is provided with the oil vapor-shutting-off up-and-down door 81.

Thus, the downstream side of the temperature decrease chamber 6, the upstream and downstream sides of the gas quenching chamber 7 and the upstream side of the oil quenching chamber 8 are provided with the up-and-down doors 62, 71, 72 and 81, respectively, that have various functions such as the thermal insulation function, the pressure resistance function, the oil vapor shut-off function, etc. Besides, these up-and-down doors 62, 71, 72 and 81 are disposed movably up and down inside the first conveying chamber 9 or the second conveying chamber 10. That is, the up-and-down doors 62, 71, 72 and 81 are isolated from external air by door pocket structures that are formed by the first conveying chamber 9 and the second conveying chamber 10, respectively.

The up-and-down doors 31, 41, 51, 61, 62, 71, 72 and 81 disposed in the continuous gas carburizing furnace 1 are provided with respective actuators (not shown). By the actuators, the up-and-down doors 31, 41, 51, 61, 62, 71, 72 and 81 are able to be individually slid in the up and down directions. Each of the up-and-down doors 31, 41, 51, 61, 62, 71, 72 and 81 constructed as described above is moved upward to an open state only when a workpieces 50 is conveyed in the direction from the preheating chamber 2 to the oil quenching chamber 8.

The preheating chamber 2 and the oil quenching chamber 8 are provided with exhaust devices 23 and 83 that have combustion devices 23*a* and 83*a*, respectively. Besides, the heating chamber 3, the carburizing chamber 4, the diffusion chamber 5 and the temperature decrease chamber 6 are equipped with carburizing gas supply devices 32, 42, 42, 52 and 63, respectively, that are each provided for supplying the carburizing gas (CO gas) into a corresponding one of the chambers and that are each made up of a compressed gas cylinder, an electromagnetic valve, a piping member, etc. Furthermore, the gas quenching chamber 7 is equipped with an inert gas supply device 73 for supplying an inert gas (nitrogen gas) into the chamber. The inert gas supply device 73 is made up of a compressed nitrogen gas cylinder, an electromagnetic valve, a piping member, etc.

Incidentally, the carburizing gas supply device 63 provided in the temperature decrease chamber 6 is controlled so as to start supplying the carburizing gas (CO gas) into the temperature decrease chamber 6 in response to the ascent (opening) of the up-and-down door 71 disposed at the upstream side of the gas quenching chamber 7, and so as to end the supply of the carburizing gas (CO gas) into the temperature decrease chamber 6 after waiting for a certain time to elapse following the descent (closure) of the up-and-down door 71, as described later.

In the inside of each of the preheating chamber 2, the heating chamber 3, the carburizing chamber 4, the diffusion chamber 5 and the temperature decrease chamber 6, left and right sides relative to the conveying direction of the workpieces 50 are provided with a plurality of heaters (not shown), and a ceiling is provided with a fan 24, 33, 43, 43, 53 or 64. As the heaters and the fans 24, 33, 43, 43, 53 and 64 are operated, the atmosphere in each of the preheating chamber 2, the heating chamber 3, the carburizing chamber 4, the diffusion chamber 5 and the temperature decrease chamber 6 is heated and stirred, whereby the chamber temperature inside the preheating chamber 2, the heating chamber 3, the carburizing chamber 4, the diffusion chamber 5 and the temperature decrease chamber 6 is increased to a temperature determined beforehand.

Thus, the continuous gas carburizing furnace 1 is constructed by contiguously disposing, in a line, the preheating chamber 2, the heating chamber 3, the carburizing chamber 4, the diffusion chamber 5, the temperature decrease chamber 6, the first conveying chamber 9, the gas quenching chamber 7, the second conveying chamber 10 and the oil quenching chamber 8, in each of which a corresponding one of the steps involved in the carburizing process is performed.

The workpieces 50 carried into the furnace undergo the various steps of the carburizing process as they sequentially pass through the chambers. Finally, the workpieces 50 can be subjected to the quenching process inside either the gas quenching chamber 7 or the oil quenching chamber 8. Thus, the method of the quenching process of the workpieces 50 can be arbitrarily selected (between the gas quenching and the oil quenching).

[Gas Carburizing Process Method for Workpieces 50 that Includes Oil Quenching Process]

Figure 2:
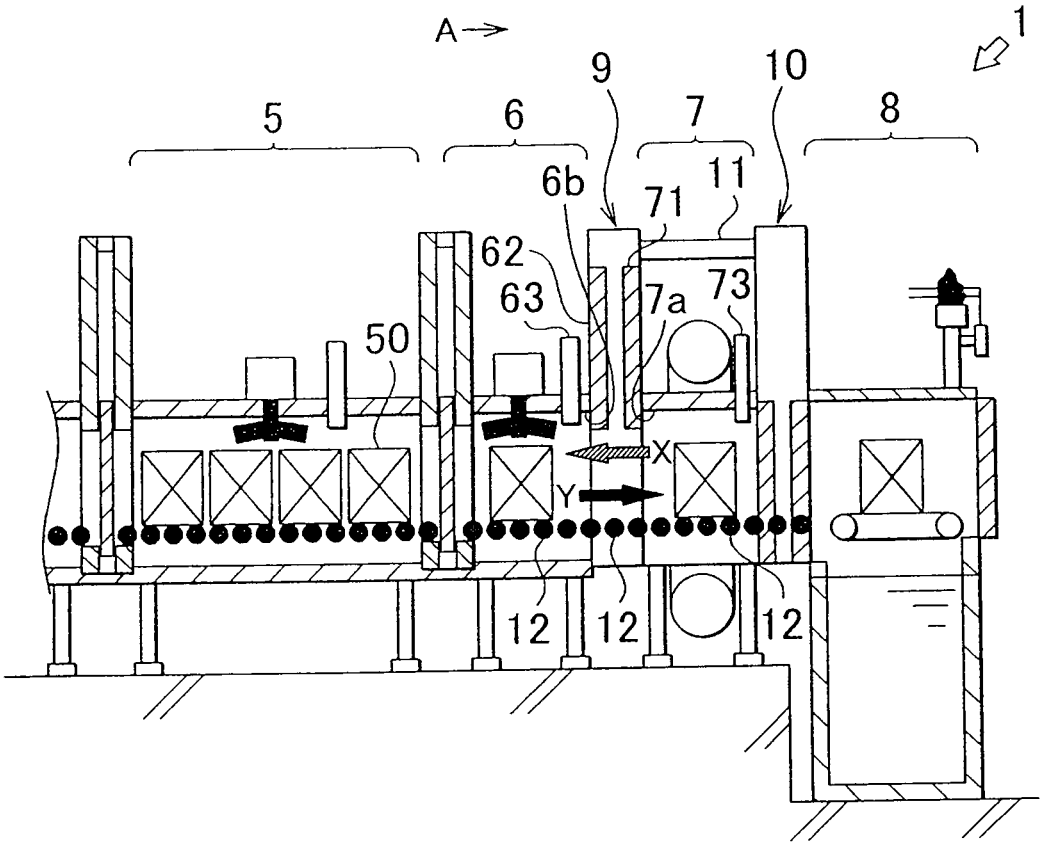
FIG. 2 is a side sectional view of a portion of the continuous gas carburizing furnace that includes a diffusion chamber and a portion of the furnace which succeeds to the diffusion chamber, showing flows of a carburizing gas (CO gas) and an inert gas between a temperature decrease chamber and a gas quenching chamber.
Figure 4:
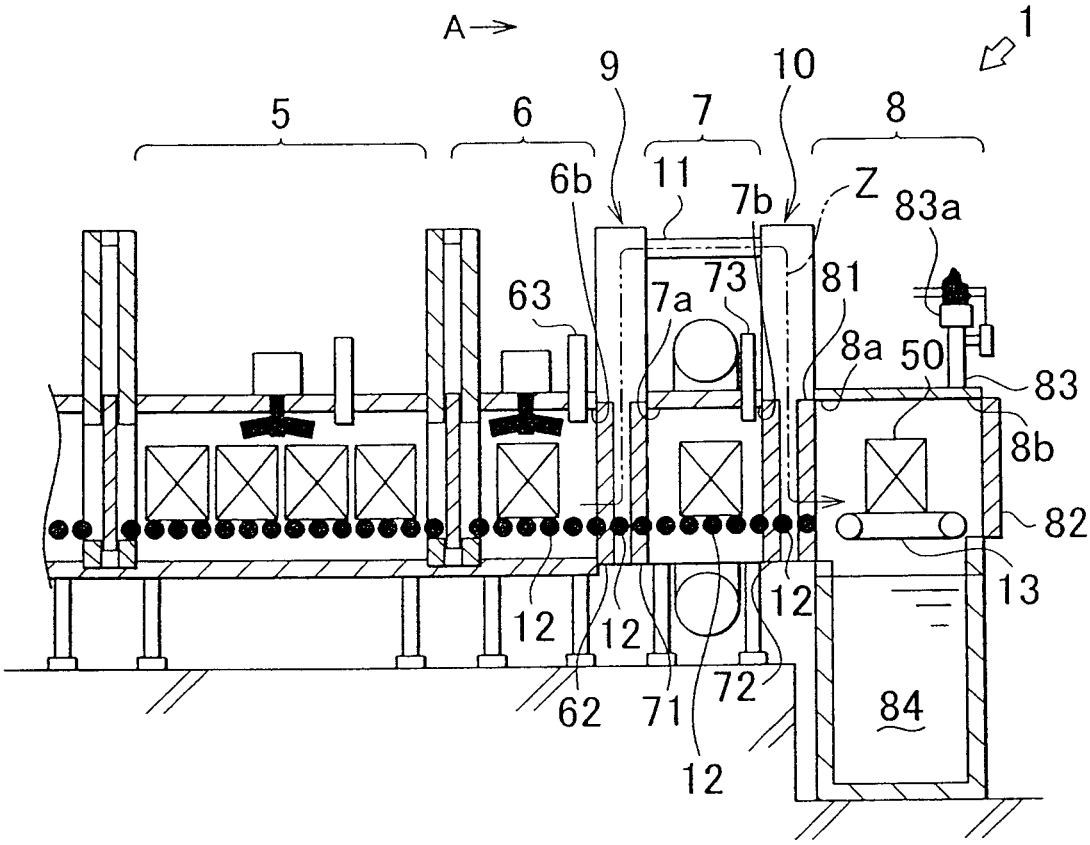
FIG. 4 is a side sectional view of the diffusion chamber of the continuous gas carburizing furnace and the portion of the furnace which succeeds to the diffusion chamber, showing flows of the carburizing gas (CO gas) between the temperature decrease chamber and the gas quenching chamber.
Figure 5:
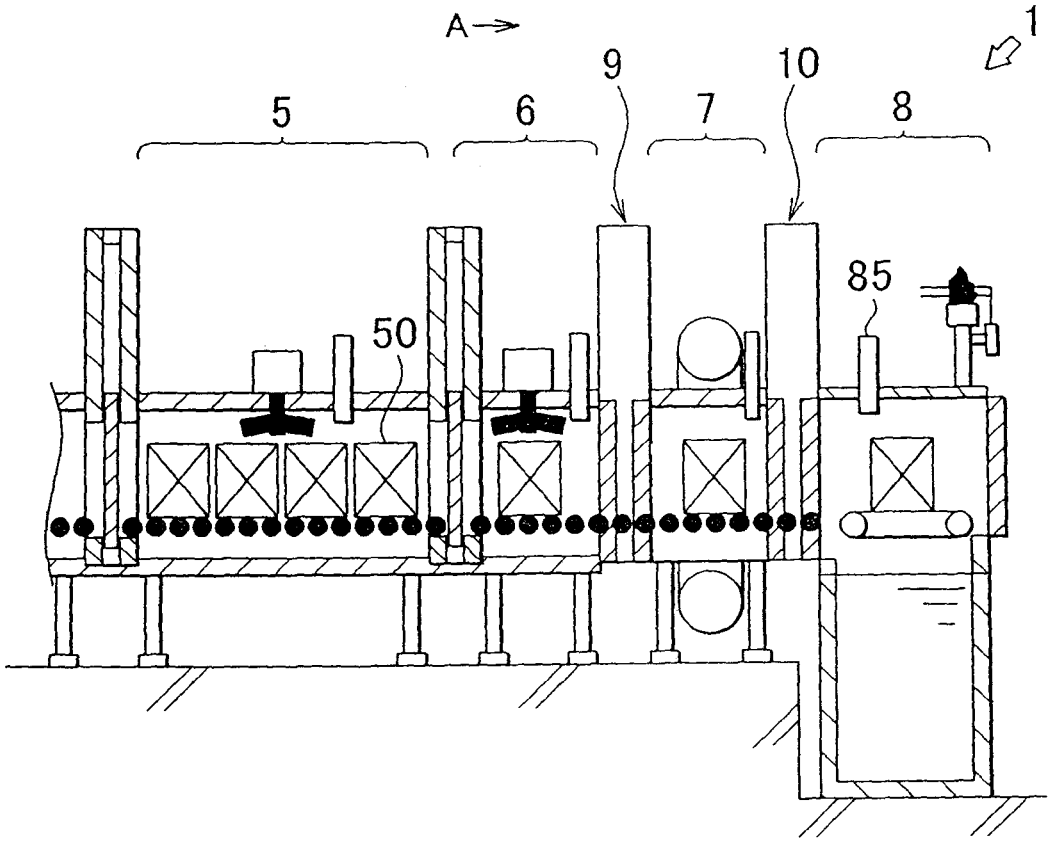
FIG. 5 is a side sectional view of the diffusion chamber of the continuous gas carburizing furnace and the portion of the furnace which succeeds to the diffusion chamber, showing an oil quenching chamber provided with a gas supply device as another embodiment.

Next, a gas carburizing process method for workpieces 50 that includes the oil quenching process according to the continuous gas carburizing furnace 1 will be described with reference to FIG. 1 to FIG. 5. For the following description, it is to be noted that the direction of an arrow A in each of FIG. 2, FIG. 4 and FIG. 5 shows the conveying direction of workpieces 50, and defines the forward direction of the continuous gas carburizing furnace 1.

Referring to FIG. 1, in the case where the gas carburizing process including the oil quenching process is to be performed on a workpiece 50 in the continuous gas carburizing furnace 1, firstly the open-close door 21 is opened while the up-and-down door 31 between the preheating chamber 2 and the heating chamber 3 is kept closed. Then, the workpiece 50 is conveyed into the preheating chamber 2 via the carry-in entrance 2*a*. At this time, the workpiece 50 is placed on an upstream side portion of the first conveying device 12 that is disposed in the preheating chamber 2.

After the workpiece 50 is conveyed into the preheating chamber 2, the open-close door 21 is closed. Then, the workpiece 50 is gradually heated to a predetermined preheat temperature (about 800° C.) by the atmosphere within the preheating chamber 2 while being conveyed by the first conveying device 12 toward the next-step chamber, that is, the heating chamber 3.

When the open-close door 21 of the preheating chamber 2 is opened, low-temperature external air (oxygen) is likely to flow into the preheating chamber 2, so that the temperature inside the preheating chamber 2 tends to sharply drop and the pressure inside the preheating chamber 2 tends to change. However, the preheating chamber 2 is equipped with the exhaust device 23, and the combustion device 23*a* of the exhaust device 23 burns the external air (oxygen) flowing into the chamber with the carburizing gas (CO gas) present in the preheating chamber 2, so that inflow of external air into the furnace is prevented.

Inside the preheating chamber 2, the workpiece 50 is conveyed by the first conveying device 12 toward the downstream side (the heating chamber 3 side). Then, the workpiece 50 approaches the vicinity of the upstream side of the heating chamber 3, the up-and-down door 31 is raised and opened. After that, the workpiece 50 is moved, without a stop, through the up-and-down door 31 by the first conveying device 12, and is conveyed into the heating chamber 3.

After the workpiece 50 is conveyed into the heating chamber 3, the up-and-down door 31 is lowered and closed. After that, the carburizing gas supply device 32 supplies the carburizing gas (CO gas) into the heating chamber 3. Then, the workpiece 50 is gradually heated to a predetermined heating temperature (about 930° C.) by the atmosphere in the heating chamber 3 while being conveyed by the first conveying device 12 toward the next-step chamber, that is, the carburizing chamber 4.

When inside the heating chamber 3, the workpiece 50 approaches the vicinity of the upstream side of the carburizing chamber 4, the up-and-down door 41 is raised and opened. After that, the workpiece 50 is moved, without a stop, through the up-and-down door 41 by the first conveying device 12, and is conveyed into the carburizing chamber 4.

When the workpiece 50 is conveyed into the carburizing chamber 4, the up-and-down door 41 is lowered and closed. After that, the carburizing gas supply devices 42 supply the carburizing gas (CO gas) whose CO concentration is about 15 to 25% by volume, so that the value of carbon potential (CP) in the carburizing chamber 4 increases. Then, the workpiece 50 is further heated (to about 950° C.) and is given carbon by the atmosphere in the carburizing chamber 4 and thus undergoes the carburizing process, while being conveyed by the first conveying device 12 toward the next-step chamber, that is, the diffusion chamber 5.

When inside the carburizing chamber 4, the workpiece 50 approaches the vicinity of the upstream side of the diffusion chamber 5, the up-and-down door 51 is raised and opened. After that, the workpiece 50 is moved, without a stop, through the up-and-down door 51 by the first conveying device 12, and is conveyed into the diffusion chamber 5.

After the workpiece 50 is conveyed into the diffusion chamber 5, the up-and-down door 51 is lowered and closed. After that, the carburizing gas supply device 52 supplies the carburizing gas (CO gas) into the diffusion chamber 5. Then, while the workpiece 50 is being conveyed by the first conveying device 12 toward the next step, that is, the temperature decrease chamber 6, the workpiece 50 maintains the heated temperature state brought about by the carburizing chamber 4, and carbon provided in the workpiece 50 by the carburizing chamber 4 diffuses well into the interior of the workpiece 50.

When inside the diffusion chamber 5, the workpiece 50 approaches the vicinity of the upstream side of the temperature decrease chamber 6, the up-and-down door 61 is raised and opened. After that, the workpiece 50 is moved, without a stop, through the up-and-down door 61 by the first conveying device 12, and is conveyed into the temperature decrease chamber 6.

After the workpiece 50 is conveyed into the temperature decrease chamber 6, the up-and-down door 61 is lowered and closed. After that, the carburizing gas supply device 63 supplies the carburizing gas (CO gas) into the temperature decrease chamber 6. Then, the workpiece 50 is gradually cooled to a predetermined temperature (about 850° C.) by the atmosphere in the temperature decrease chamber 6, while being conveyed by the first conveying device 12 toward the next step, that is, the oil quenching chamber 8.

When inside the temperature decrease chamber 6, the workpiece 50 approaches the vicinity of the upstream side of the first conveying chamber 9, both the up-and-down door 62 and the up-and-down door 71 that are disposed inside the first conveying chamber 9 are raised and opened.

It is to be noted herein that when the up-and-down door 62 and the up-and-down door 71 are both raised and opened and therefore the temperature decrease chamber 6 and the gas quenching chamber 7 communicate with each other as shown in FIG. 2, the inert gas in the gas quenching chamber 7 flows into the temperature decrease chamber 6 (as indicated by an arrow X in FIG. 2) and the carburizing gas (CO gas) in the temperature decrease chamber 6 flows into the gas quenching chamber 7 (as indicated by an arrow Y in FIG. 2).

Figure 3:
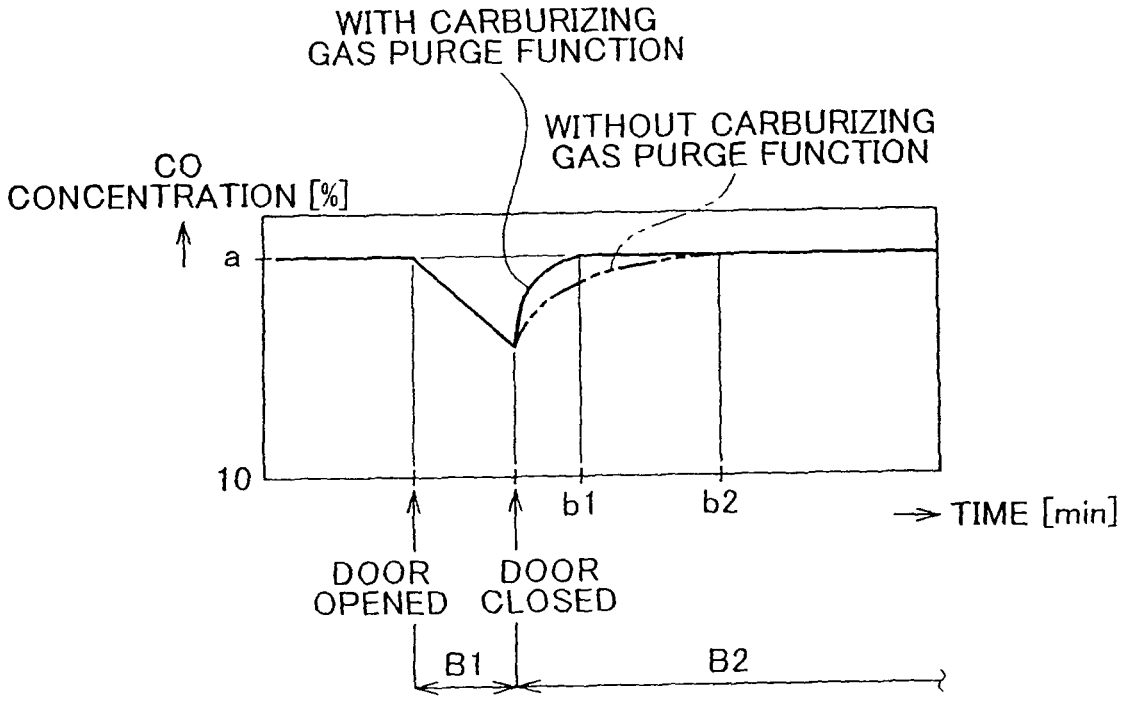
FIG. 3 is a diagram showing changes in the CO concentration in the temperature decrease chamber.

As a result, the CO concentration in the temperature decrease chamber 6 sharply declines (in a region B1 in FIG. 3), and after the up-and-down door 62 is lowered and closed (in a region B2 in FIG. 3), a time of minutes is required (as indicated at b2 in FIG. 3) before the CO concentration in the atmosphere in the temperature decrease chamber 6 is increased to a predetermined CO concentration (a % in FIG. 3).

Therefore, after the opening and closing movements of the up-and-down door 62, the CO concentration in the atmosphere in the temperature decrease chamber 6 remains low for a long time, so that decarburization may occur near the surface of the workpiece 50 that has undergone the carburization and the diffusion of carbon, and therefore the workpiece 50 having been subjected to the carburizing process may fail in achieving a predetermined necessary surface strength.

Hence, in this embodiment, a carburizing gas purge mechanism made up of the carburizing gas supply device 63 is provided so that after the up-and-down door 62 is lowered and closed (in the region B2 in FIG. 3), the CO concentration in the atmosphere in the temperature decrease chamber 6 will be increased to the predetermined CO concentration (a % in FIG. 3) in a short time (b1 in FIG. 3, where b1<b2).

That is, in this embodiment, when the up-and-down door 71 disposed on the upstream side of the gas quenching chamber 7 is opened, the carburizing gas supply device 63 resupplies the carburizing gas (CO gas) into the temperature decrease chamber 6. This supply of the carburizing gas (CO gas) is continued till the elapse of a predetermined fixed time after the up-and-down door 71 is closed simultaneously with the up-and-down door 62 that is disposed on the downstream side of the temperature decrease chamber 6. By controlling the carburizing gas supply device 63 in this manner, the continuous gas carburizing furnace 1 of this embodiment quickly increases the CO concentration in the atmosphere in the temperature decrease chamber 6 from the reduced level resulting from the opening and closing movements of the up-and-down door 62 back to the normal level of CO concentration.

Therefore, the time during which the CO concentration in the atmosphere in the temperature decrease chamber 6 remains low after the up-and-down door 62 is opened and closed is shortened, so that the predetermined necessary surface strength can be secured as much as possible for the workpiece 50 that has been subjected to the carburizing process.

When both the up-and-down door 62 and the up-and-down door 71 are raised and opened, the workpiece 50 in the temperature decrease chamber 6 is moved, without a stop, through the first conveying chamber 9 by the first conveying device 12, and is conveyed into the gas quenching chamber 7.

After the workpiece 50 is conveyed into the gas quenching chamber 7, the up-and-down door 62 and the up-and-down chamber 71 are together lowered and closed. At this stage, if the oil quenching process has been selected as the quenching process of the workpiece 50, the workpiece 5 is immediately conveyed through the gas quenching chamber 7 toward the downstream side (the second conveying chamber 10 side) by the first conveying device 12, without any particular process being performed in the gas quenching chamber 7.

When inside the gas quenching chamber 7, the workpiece 50 approaches the vicinity of the upstream side of the second conveying chamber 10, the up-and-down door 72 and the up-and-down door 81 that are disposed inside the second conveying chamber 10 are together raised and opened. After that, the workpiece 50 is moved, without a stop, through the second conveying chamber 10 by the first conveying device 12, and is conveyed into the oil quenching chamber 8. Than, the workpiece 50 transfers to the second conveying device 13, and is thereby conveyed to a center in the oil quenching chamber 8.

After the workpiece 50 is conveyed into the oil quenching chamber 8, the up-and-down door 72 and the up-and-down door 81 are together lowered and closed. After that, the workpiece 50, upon reaching the center inside the oil quenching chamber 8, is lowered and submerged into the oil tank 84 via a lifting-and-lowering device (not shown). As a result, the workpiece 50 is rapidly cooled to or below 200° C., and thus the oil quenching process of the surface portion of the workpiece 50 is performed. After a predetermined fixed time elapses, the workpiece 50 is lifted up again from the oil tank 84 by the lifting-and-lowering device.

The workpiece 50, after being lifted up from the oil tank 84, is conveyed through the inside of the oil quenching chamber 8 to the downstream side (the carry-out exit 8*b* side) by the second conveying device 13. Then, when the workpiece 50 approaches the vicinity of the carry-out exit 8*b* of the oil quenching chamber 8, the open-close door 82 is opened, and the workpiece 50 is conveyed out of the furnace 1 through the carry-out exit 8*b*.

It is to be noted herein that in this embodiment, the amount of external air (oxygen) that flows into the oil quenching chamber 8 due to the opening and closing movements of the open-close door 82 is reduced by introducing the carburizing gas (CO gas) from the temperature decrease chamber 6 into the second conveying chamber 10.

Specifically, as shown in FIG. 4, the first conveying chamber 9 disposed at the downstream side of the temperature decrease chamber 6 and adjacent to the temperature decrease chamber 6, and the second conveying chamber 10 disposed at the upstream side of the oil quenching chamber 8 and adjacent to the oil quenching chamber 8 are linked to each other by the communication pathway 11. Besides, the up-and-down door 62 disposed at the outlet portion 6*b* of the temperature decrease chamber 6 has a plurality of small hole portions, so that through the hole portions, the carburizing gas (CO gas) flows from the temperature decrease chamber 6 into the first conveying chamber 9 not only when the up-and-down door 62 is opened and closed, but all the time.

Therefore, the carburizing gas (CO gas) filling the first conveying chamber 9 is guided into the second conveying chamber 10 through the communication pathway 11, and then is supplied therefrom into the oil quenching chamber 8 every time the up-and-down door 81 is opened.

Thus, since the carburizing gas (CO gas) from the temperature decrease chamber 6 is guided through the first conveying chamber 9, the communication pathway 11, and the second conveying chamber 10 in that order, and then is supplied into the oil quenching chamber 8 (as shown by an arrow Z in FIG. 4), the oil quenching chamber 8 is filled with the carburizing gas (CO gas). Therefore, the amount of external air (oxygen) that flows into the oil quenching chamber 8 as the open-close door 82 is opened and closed is reduced due to the blockage by the carburizing gas (CO gas), so that the poor quality of the workpieces 50 resulting from the oxidation during the oil quenching process is reduced.

Incidentally, although in the embodiment, the first conveying chamber 9 and the second conveying chamber 10 are interlinked by one communication pathway 11, this construction is not restrictive but a plurality of communication pathways may also be provided.

Besides, when the up-and-down door 81 of the oil quenching chamber 8 is opened, the high-temperature carburizing gas (CO gas) from the oil quenching chamber 8 is likely to flow into the oil quenching chamber 8, so that the temperature inside the oil quenching chamber 8 tends to sharply rise and the pressure inside the oil quenching chamber 8 tends to sharply change. However, the oil quenching chamber 8 is provided with the exhaust device 83, and the combustion device 83*a* of the exhaust device 83 burns a portion of the carburizing gas (CO gas) flowing into the oil quenching chamber 8 with the external air that flows in small amount into the oil quenching chamber 8, so that the entrance of external air into the furnace is substantially prevented.

Alternatively, as another embodiment, the oil quenching chamber 8 may be equipped with a gas supply device 85 in order to reduce the amount of external air (oxygen) that flows into the oil quenching chamber 8. That is, as shown in FIG. 5, the oil quenching chamber 8 in another embodiment is equipped with a gas supply device 85 that is provided for directly supplying the carburizing gas (CO gas) or an inert gas (e.g., nitrogen gas) directly into the oil quenching chamber 8 and that is made up of a compressed gas cylinder, an electromagnetic valve, a piping member, etc.

Due to the gas supply device 85, the oil quenching chamber 8 is filled with the carburizing gas (CO gas) or the inert gas (nitrogen gas), so that the amount of external air (oxygen) that flows into the oil quenching chamber 8 is reduced due to the blockage by the carburizing gas (CO gas) or the insert gas (nitrogen gas). Thus, the poor quality of the workpieces 50 resulting from the oxidation during the oil quenching process is reduced.

[Gas Carburizing Process Method for Workpieces 50 that Includes Gas Quenching Process]

Next, a gas carburizing process method for workpieces 50 that includes the gas quenching process according to the continuous gas carburizing furnace 1 will be described with reference to FIG. 1. In the case where the gas quenching process is selected as the quenching process performed on a workpiece 50 that has been subjected to the carburization and the diffusion of carbon, the gas carburizing process method employed is different in the processes that are performed on the workpiece 50 after the temperature decrease chamber 6, from the foregoing process method employed in the case where the oil quenching process is selected.

That is, a workpiece 50 put into the preheating chamber 2 undergoes the carburization and the diffusion of carbon as the workpiece 50 passes through the preheating chamber 2, the heating chamber 3, the carburizing chamber 4, the diffusion chamber 5 and the temperature decrease chamber 6 in that order, as in the case where the oil quenching process is selected.

After the workpiece 6 is conveyed out of the temperature decrease chamber 6 and into the gas quenching chamber 7, the up-and-down door 62 and the up-and-down door 71 are together lowered and closed. At this time, in the case where the gas quenching process has been selected as the quenching process of the workpiece 50, the inert gas supply device 73 supplies the insert gas (nitrogen gas) into the gas quenching chamber 7. Then, the workpiece 50 is rapidly cooled to or below about 200° C. by the inert gas (nitrogen gas) and thus undergoes the gas quenching process, while being conveyed by the first conveying device 12 toward the downstream side (the second conveying chamber 10 side).

Then, after a predetermined fixed time elapses, the inert gas supply device 73 is stopped, and the gas quenching chamber 7 is vacuumed by a vacuum purge device (not shown) that is provided for the gas quenching chamber 7. Incidentally, the vacuuming of the inside of the gas quenching chamber 7 is performed for the following purpose. That is, since due to the supply of the inert gas (nitrogen gas), the pressure in the gas quenching chamber 7 rises, a pressure difference occurs between the inside of the gas quenching chamber 7 and the inside of the second conveying chamber 10, and therefore may make it impossible to open the up-and-down door 72. This is prevented by the vacuuming.

When inside the gas quenching chamber 7, the vacuuming by the vacuum purge device is finished and the workpiece 50 approaches the vicinity of the upstream side of the second conveying chamber 50, the up-and-down door 72 and the up-and-down door 81 that are disposed inside the second conveying chamber 10 are together raised and opened. After that, the workpiece 50 is moved, without a stop, through the second conveying chamber 10 by the first conveying device 12. Then, the workpiece 50 transfers to the second conveying device 13, and is conveyed into the oil quenching chamber 8.

After the workpiece 50 is conveyed into the oil quenching chamber 8, the up-and-down door 72 and the up-and-down door 81 are together lowered and closed. At this stage, since the gas quenching process has been selected as the quenching process for the workpiece 50, the workpiece 50 is immediately conveyed by the second conveying device 13 through the oil quenching chamber 8 to the downstream side (the carry-out exit 8*b* side), without any particular process being performed in the oil quenching chamber 8.

Then, when the workpiece 50 approaches the vicinity of the carry-out exit 8*b* of the oil quenching chamber 8, the open-close door 82 is opened, and the workpiece 50 is conveyed out of the furnace through the carry-out exit 8*b*.

Thus, in the continuous gas carburizing furnace 1 in this embodiment, a workpiece 50 undergoes the carburization and the diffusion of carbon as the workpiece 50 passes through the preheating chamber 2, the heating chamber 3, the carburizing chamber 4, the diffusion chamber 5 and the temperature decrease chamber 6 in that order. The selection between the gas quenching process and the oil quenching process is arbitrarily made by determining in which one of the gas quenching chamber 7 and the oil quenching chamber 8 the workpiece 50 is to be subjected to the quenching process when the workpiece 50 passes through the first conveying device 9, the gas quenching chamber 7, the second conveying chamber 10 and the oil quenching chamber 8.

[Changes in Temperature of Workpieces and Pressure in Each Chamber During One Cycle of Gas Carburizing Process]

Next, changes in the temperature of workpieces 50 and changes in the temperature in each chamber during a cycle of the gas carburizing process will be described separately for the different methods of the quenching process with reference to FIGS. 6A and 6B and FIGS. 7A and 7B.

Firstly, description will be made in conjunction with the case where the oil quenching process has been selected as the quenching process, with reference to FIGS. 6A and 6B. In this case, a workpiece 50 is heated to about 800° C. by the atmosphere in the preheating chamber 2, and then is heated to about 930° C. by the atmosphere in the heating chamber 3. Then, the temperature of the workpiece 50 is further raised to about 950° C. by the atmosphere in the carburizing chamber 4, and the carburization of the workpiece 50 is performed in the chamber 4.

Figure 6A:
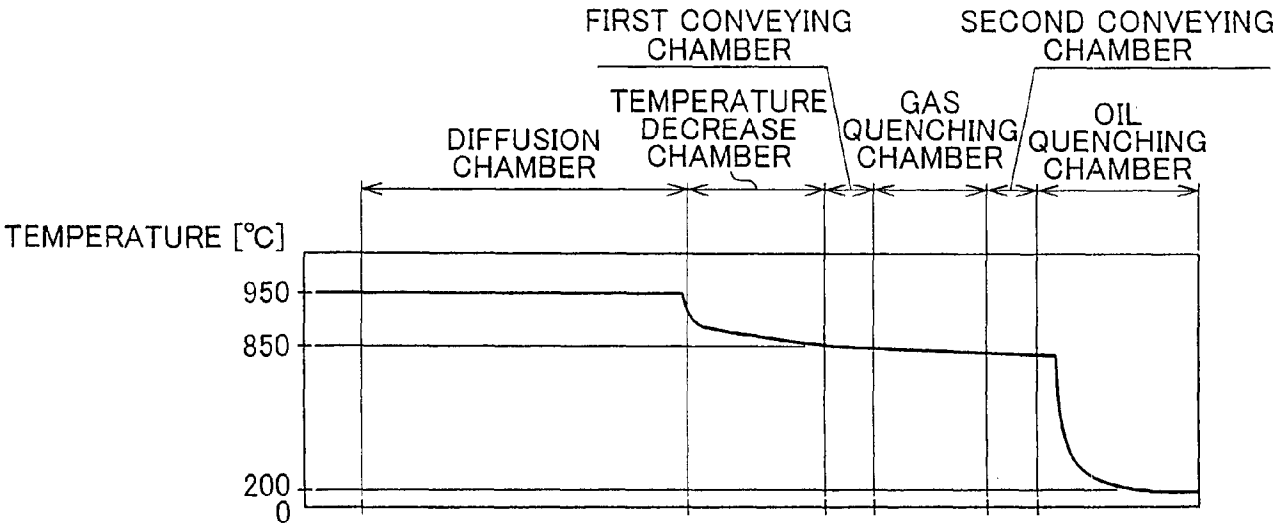
FIGS. 6A and 6B are diagrams showing rates of change of the temperature of a workpiece and of the pressure in chambers during a cycle of a gas carburizing process that includes an oil quenching process.
Figure 6B:
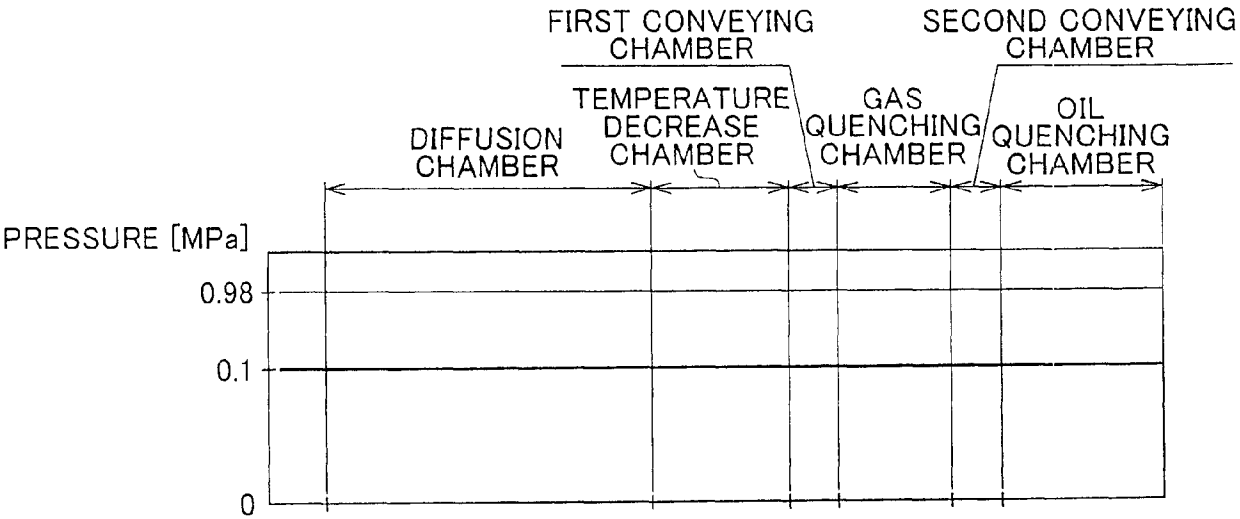

After that, as shown in FIG. 6A, the temperature of the workpiece 50 continues to be kept at about 950° C. to which the workpiece 50 is heated in the previous step, that is, the carburizing chamber 4. Then, immediately after the workpiece 50 is conveyed into the temperature decrease chamber 6 (more concretely, immediately after the up-and-down door 61 is opened), the temperature of the workpiece 50 is rapidly lowered to about 850° C.

After the workpiece 50 is conveyed out of the temperature decrease chamber 6, the temperature of the workpiece 50 is kept at about 850° C. while the workpiece 50 passes sequentially through the first conveying chamber 9, the gas quenching chamber 7 and the second conveying chamber 10. Then, in the oil quenching chamber 8, which is the final step, the workpiece 50 is rapidly cooled to about 200° C. by submerging it into the oil tank 84. Incidentally, the reason why the temperature of the workpiece 50 continues to be about 850° C. immediately after the workpiece 50 is conveyed into the oil quenching chamber 8 as shown in FIG. 6A is that a certain amount of time, such as an operation time of a lifting-and-lowering device, or the like, is needed before the workpiece 50 is submerged into the oil tank 84.

On the other hand, as for the pressure in each chamber, when the workpiece 50 is put into the preheating chamber 2, low-temperature external air (oxygen) is likely to flow into the preheating chamber 2, so that the pressure inside the preheating chamber 2 tends to change, as described above. Due to the exhaust device 28, the pressure in the preheating chamber 2 is kept at about 0.1 MPa.

Besides, when the workpiece 50, after being conveyed out of the preheating chamber 2, passes sequentially through the heating chamber 3 and the carburizing chamber 4, the opening and closing movements of the up-and-down doors 31 and 41 are likely to cause certain amounts of flow of the atmosphere in each chamber, and therefore the pressure therein tends to fluctuate. However, as described above, the carburizing gas supply devices 32 and 42 are provided for supplying the carburizing gas (CO gas). Therefore, the pressure inside the heating chamber 3 and the carburizing chamber 4 continues to be kept at about 0.1 MPa, which is substantially equal to the atmospheric pressure.

After that, when the workpiece 50 sequentially passes through the diffusion chamber 5, the temperature decrease chamber 6, the first conveying chamber 9, the gas quenching chamber 7, the second conveying chamber 10 and the oil quenching chamber 8, the carburizing gas supply devices 52 and 63 supply the carburizing gas (CO gas) as described above. Therefore, the pressure inside the diffusion chamber 5, the temperature decrease chamber 6, the first conveying chamber 9, the gas quenching chamber 7, the second conveying chamber 10 and the oil quenching chamber 8 continues to be kept at about 0.1 MPa, which is substantially equal to the atmospheric pressure.

Incidentally, as described above, when the workpiece 50 is put into the oil quenching chamber 8, the high-temperature carburizing gas (CO gas) is likely to flow into the oil quenching chamber 8, and the pressure in the oil quenching chamber 8 tends to change. However, due to the exhaust device 83, the pressure in the quenching chamber 8 is kept at about 0.1 MPa, which is substantially equal to the atmospheric pressure.

Next, description will be made in conjunction with the case where the gas quenching process has been selected as the quenching process, with reference to FIGS. 7A and 7B. In this case, the temperature of the workpiece 50 changes in the same manner as in the foregoing case where the oil quenching process has been selected, until the workpiece reaches the first conveying chamber 9.

Figure 7A:
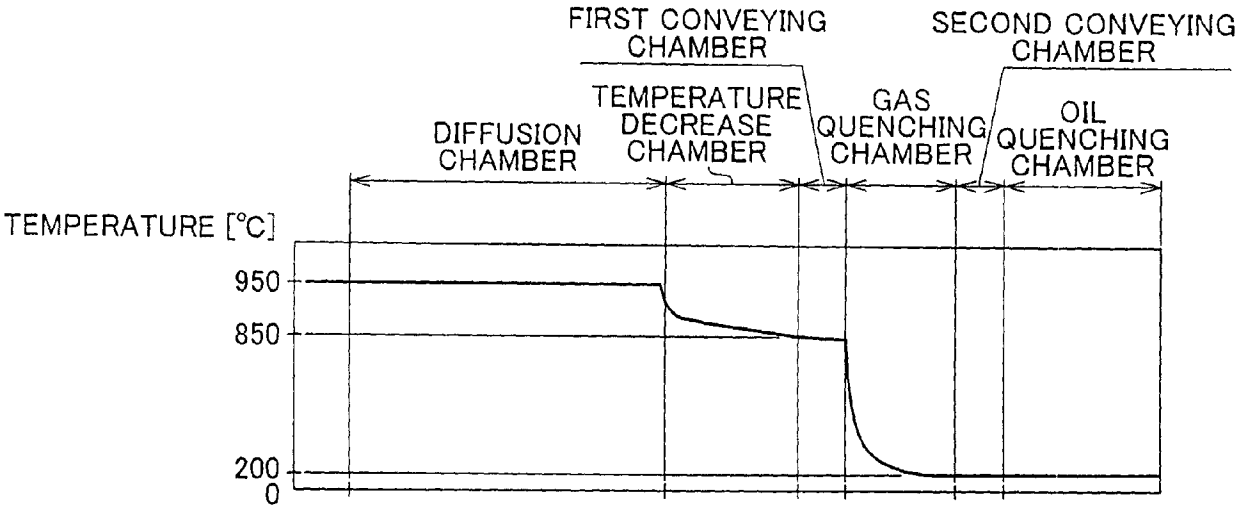
FIGS. 7A and 7B are diagrams showing rates of change of the temperature of a workpiece and of the pressure in chambers during a cycle of a gas carburizing process that includes a gas quenching process.

As shown in FIG. 7A, the workpiece 50 is rapidly cooled to or below about 200° C. immediately after the workpiece 50 is conveyed into the gas quenching chamber 7. After that, while the lowered temperature is maintained, the workpiece 50 passes sequentially through the second conveying chamber 10 and the oil quenching chamber 8.

As for the pressure in each chamber, on the other hand, until the workpiece 50 reaches the first conveying chamber 9, the pressure inside the each chamber is kept at about 0.1 MPa, which is substantially equal to the atmospheric pressure, as in the foregoing case where the oil quenching process has been selected.

Figure 7B:
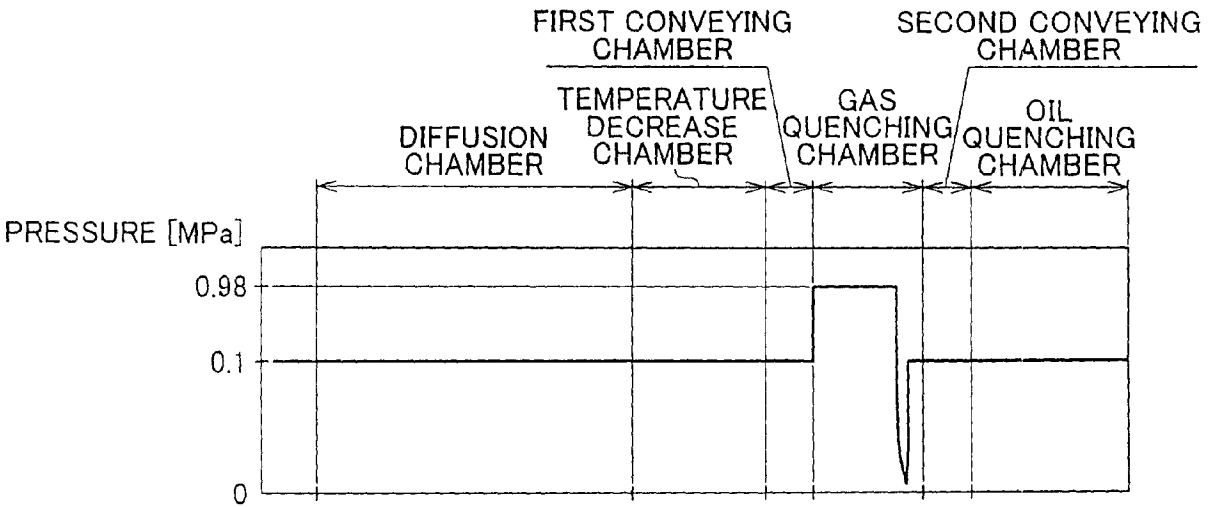

Then, immediately after the workpiece 50 is conveyed into the gas quenching chamber 7, the pressure inside the gas quenching chamber 7 is rapidly raised to about 0.98 MPa, as shown in FIG. 7B, by supplying thereinto the inert gas (nitrogen gas) from the inert gas supply device 73.

After that, after a predetermined fixed time elapses, the inert gas supply device 73 stops, and the pressure in the gas quenching chamber 7 is temporarily reduced to the vicinity of about 0 MPa by a vacuum purge device. Then, after the vacuum purge device stops and the pressure in the gas quenching chamber 7 is brought back to about 0.1 MPa, which is substantially equal to the atmospheric pressure, the workpiece 50 is conveyed sequentially through the second conveying chamber 10 and the oil quenching chamber 8. The pressure inside the second conveying chamber 10 and the pressure inside the oil quenching chamber 8 are kept at about 0.1 MPa, which is substantially equal to the atmospheric pressure.

As described above, the continuous gas carburizing furnace in the embodiment is the continuous gas carburizing furnace 1 in which the processing steps are serially arranged in a line along the conveying direction of a workpiece 50, and which includes: the gas carburizing processing chambers (the preheating chamber 2, the heating chamber 3, the carburizing chamber 4, the diffusion chamber 5 and the temperature decrease chamber 6) in which the gas carburizing process is performed on the workpiece 50; the oil quenching chamber 8 in which the oil quenching is performed on the workpiece 50; and the gas quenching chamber 7 in which the gas quenching is performed on the workpiece 50. The gas carburizing processing chambers further include the temperature decrease chamber 6 in which the temperature of the workpiece 50 having been heated by the gas carburizing process is lowered. The temperature decrease chamber 6, the gas quenching chamber 7 and the oil quenching chamber 8 are arranged in that order from the upstream side to the downstream side in the conveying direction of the workpiece 50, and are arranged adjacent to each other.

According to the continuous gas carburizing furnace 1 of the embodiment having the foregoing construction, it is possible to provide a continuous gas carburizing furnace that is capable of arbitrary selection between the gas quenching and the oil quenching and that requires only a small installation space, and does not require a large amount of equipment cost, and achieves high productivity, and has a simple construction, and that has high reliability as the entire equipment.

That is, since the continuous gas carburizing furnace 1 has the construction in which the process steps of the preheating chamber 2, the heating chamber 3, the carburizing chamber 4, the diffusion chamber 5, the temperature decrease chamber 6, the gas quenching chamber 7 and the oil quenching chamber 8 are serially arranged in a line, the selection between the gas quenching process and the oil quenching process can be arbitrarily made by determining in which one of the gas quenching chamber 7 and the oil quenching chamber 8 the quenching process is actually performed on a workpiece 50 while the workpiece 50 is being conveyed.

Figure 9A:
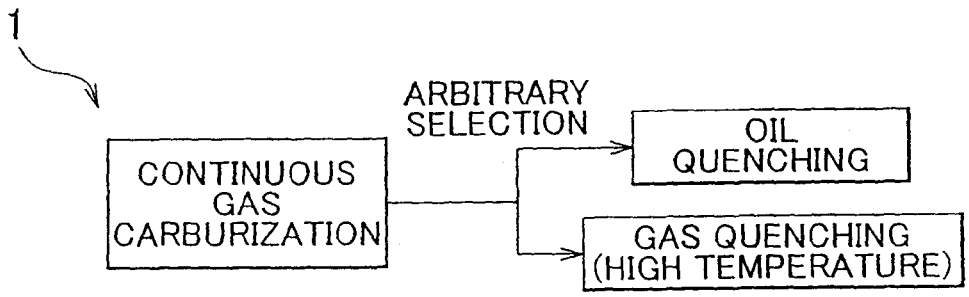
FIGS. 9A and 9B are block diagrams showing flows of steps in a carburizing furnace.
Figure 9B:
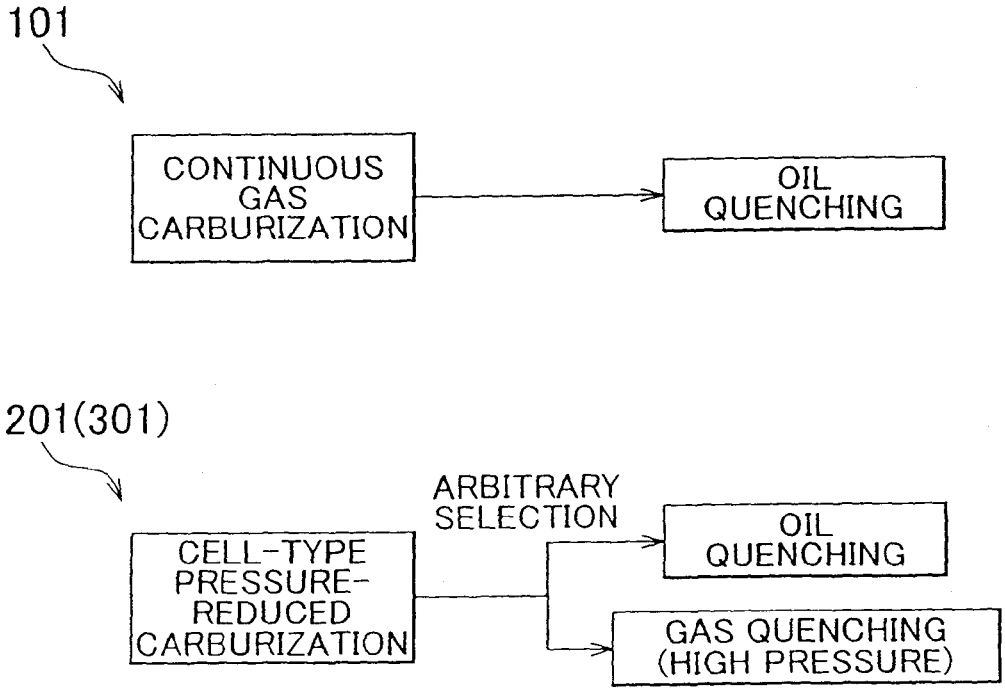
Figure 10:
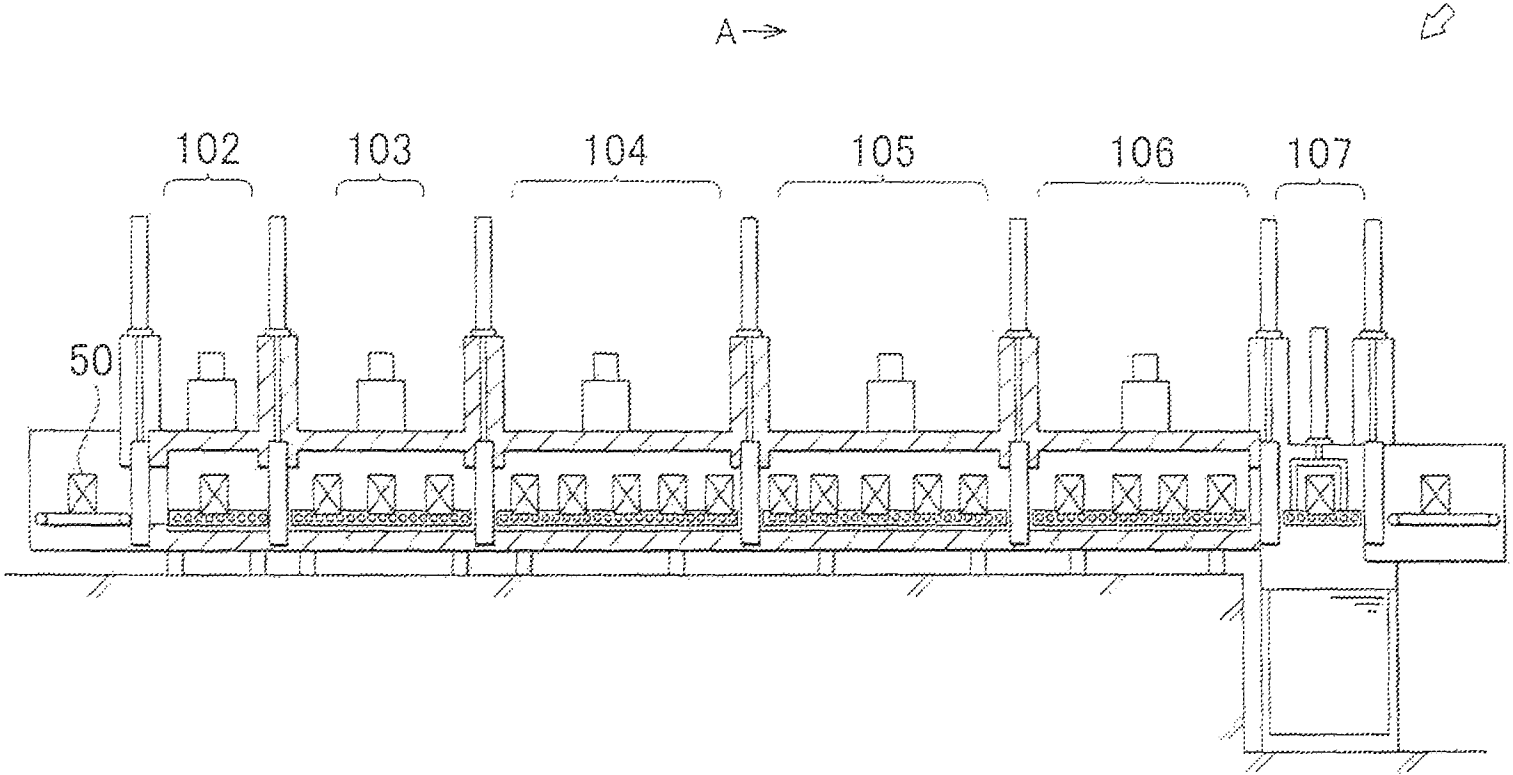
PRIOR ART FIG. 10
FIG. 10 is a side sectional view of an overall construction of a related-art continuous gas carburizing furnace.
Figure 11A:
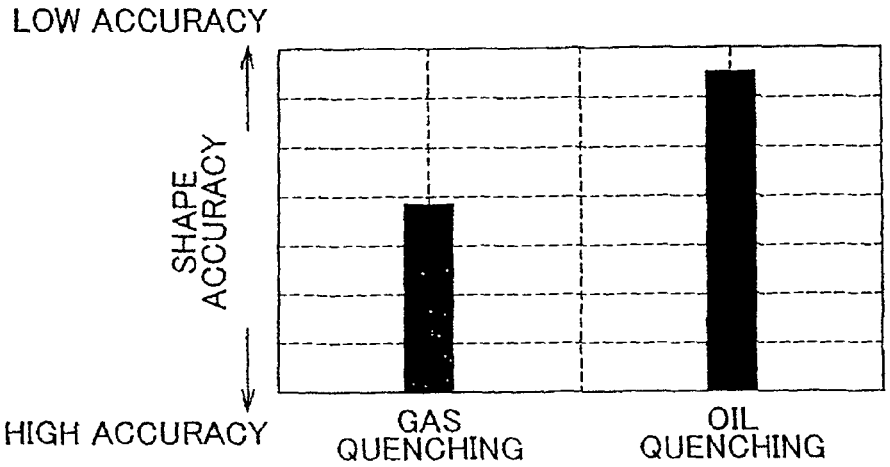
FIGS. 11A and 11B are bar charts showing comparison in product accuracy between oil quenching and gas quenching with regard to toothed wheels as an example of the workpieces.
Figure 11B:
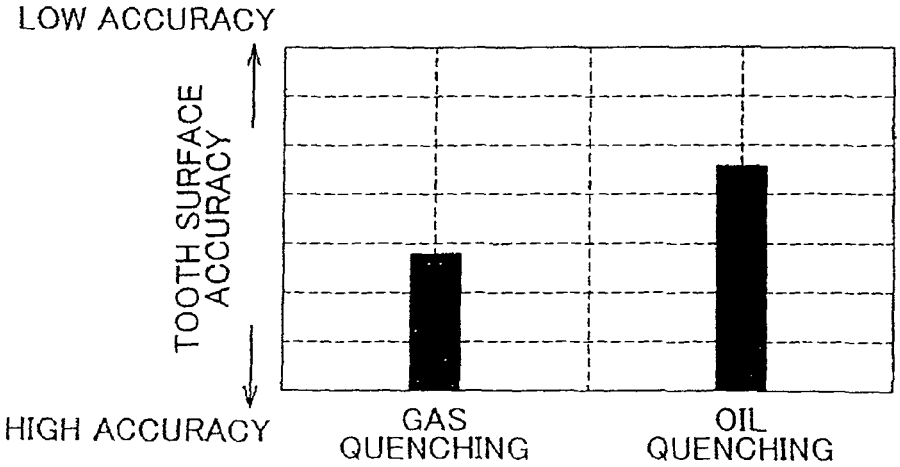
Figure 12A:
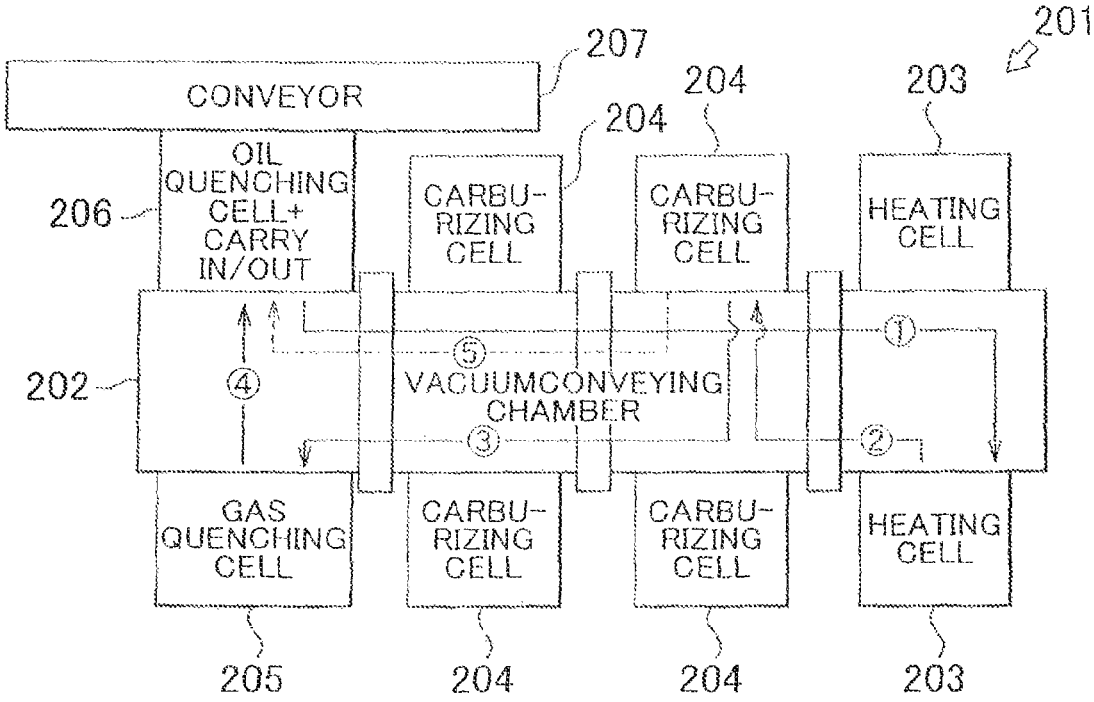
FIG. 12A PRIOR ART
FIGS. 12A and 12B schematic plan views, of showing overall constructions of related-art cell-type reduced-pressure carburizing furnaces.
Figure 12B:
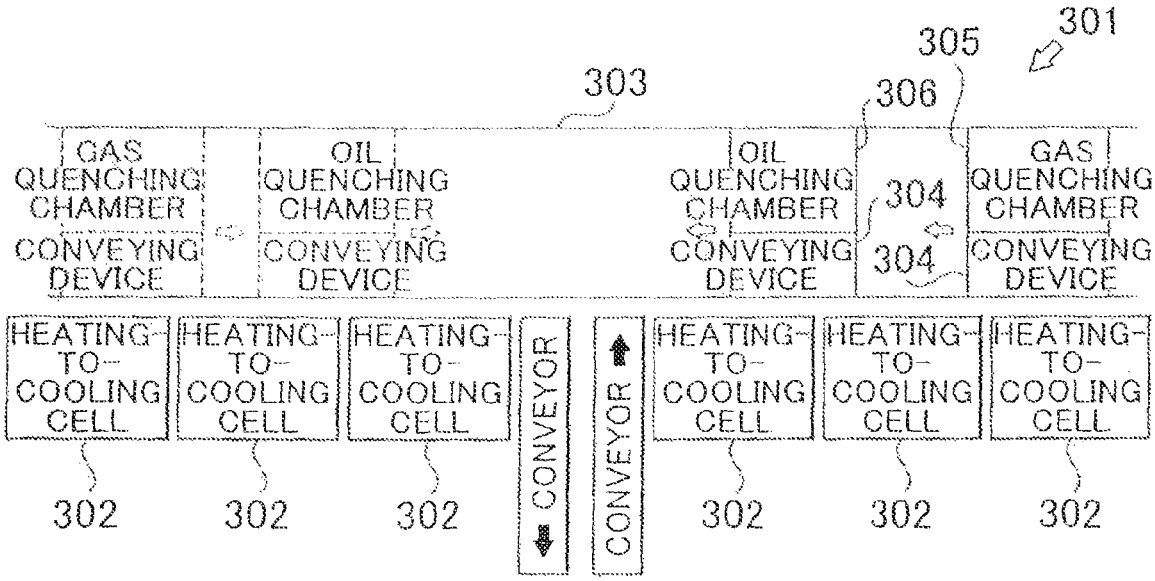

Besides, according to the continuous gas carburizing furnace 1 constructed as described above, a large quantity of workpieces 50 can be continually subjected to the carburizing process at a time, and therefore high productivity can be achieved. Comparative examples, as shown in FIG. 9B, include a method in which a workpiece 50 having gone through the carburization and the diffusion of carbon is to be subjected to the gas quenching by using a cell-type reduced-pressure carburizing furnace 201 (301) whose productivity is low, and a method in which a high-productivity continuous gas carburizing furnace 101 is employed and only the oil quenching process, not the gas quenching process, can be performed. However, as shown in FIG. 9A, since the continuous gas carburizing furnace 1 is capable of arbitrary selection between the gas quenching process and the oil quenching process, the continuous gas carburizing furnace 1 is able to perform the gas quenching on the workpiece having gone through the carburization and the diffusion of carbon, while maintaining high productivity, for all the needs regarding the production conditions for workpieces 50.

Figure 8:
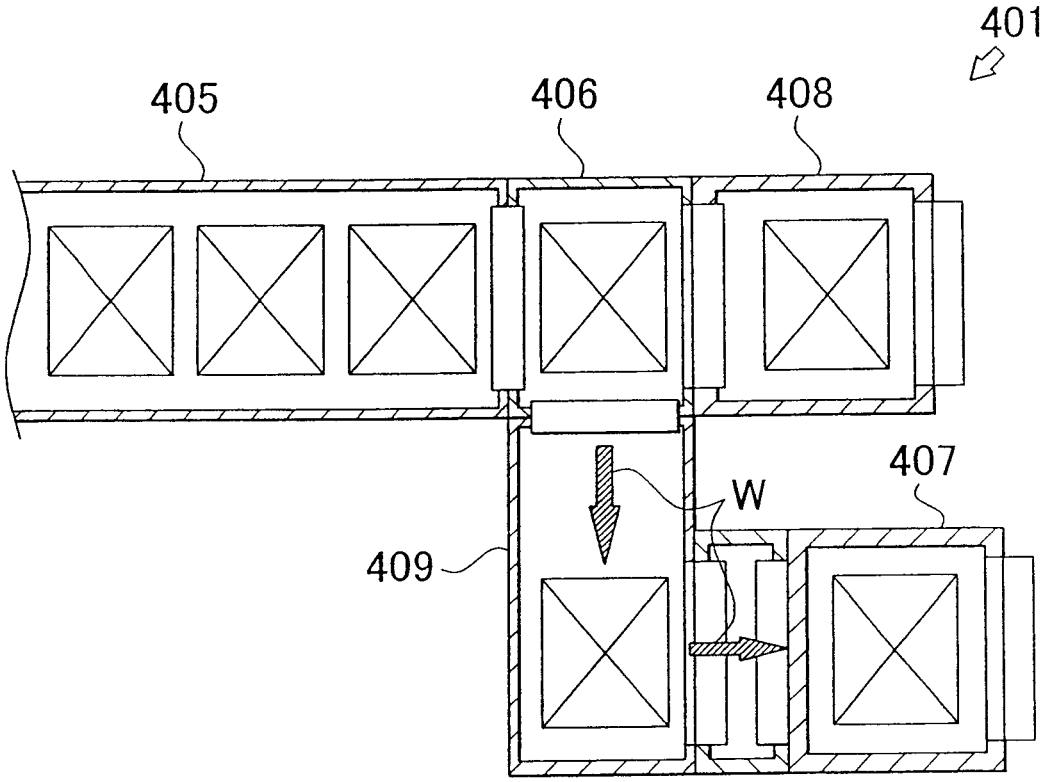
FIG. 8 is a plan sectional view of a diffusion chamber of a continuous gas carburizing furnace and a portion of the furnace which succeeds to the diffusion chamber and in which an oil quenching chamber and a gas quenching chamber are provided in parallel with each other.

In the case where, as shown in FIG. 8, a diffusion chamber 405, a temperature decrease chamber 406 and an oil quenching chamber 408 are arranged in a line along the conveying direction of workpieces 50 in a downstream side portion of a gas carburizing furnace 401, and where a gas quenching chamber 407 is disposed in parallel with the oil quenching chamber 408, there arises a need for a conveying device capable of conveying a workpiece in a direction orthogonal to the conveying direction of workpieces 50 from the temperature decrease chamber 406 to the oil quenching chamber 408, and then conveying the workpiece in a direction parallel to the conveying direction (in the direction of an arrow W in FIG. 8), toward the gas quenching chamber 407.

If such a conveying device made up of a complicated mechanism is provided within a conveying chamber 409 filled with a high-temperature carburizing gas (CO gas), a low maintenance characteristic results, and it becomes difficult to secure reliability as the entire equipment. Besides, in such a conveying device, the mechanism becomes complicated, and the number of component parts increases, and the equipment cost becomes higher as a whole. Furthermore, since the number of drive mechanisms that need to be installed outside the furnace becomes great, the conveying chamber 409 needs to have a plurality of through holes for interlinking the drive mechanisms and the conveying mechanisms, resulting in reduced air tightness of the inside of the furnace. As a result, external air enters the carburizing chamber (not shown in FIG. 8) as well as the diffusion chamber 405 and the temperature decrease chamber 406, and reduces the CO concentration in these chambers and reduces the temperature therein, leading to increased variations in the carburization hardening depth and the product accuracy of workpieces 50, and to an increased risk that the spontaneous ignition temperature might be reached and an explosion might occur.

In contrast with the gas carburizing furnace 401 constructed as described above, the continuous gas carburizing furnace 1, having the construction in which the process steps are arranged in a line along the conveying direction of workpieces 50, makes it possible to construct the conveying mechanisms for the workpieces 50 only from the first conveying device 12 and the second conveying device 13 that are each made up of a roller conveyor, a chain conveyor or the like. Therefore, the mechanism is simplified and the maintenance characteristic improves, and therefore high reliability is secured as the entire equipment. Furthermore, the layout of the entire equipment becomes simple, and the required installation space can be reduced, and the equipment cost can be reduced.

Besides, the continuous gas carburizing furnace 1 of this embodiment has a construction in which: the first conveying chamber 9 that covers the outlet portion 6*b* of the temperature decrease chamber 6 and the inlet portion 7*a* of the gas quenching chamber 7 which are provided in the side surface portions of the two chambers which face each other across the first conveying chamber 9 is provided between the temperature decrease chamber 6 and the gas quenching chamber 7; the second conveying chamber 10 that covers the outlet portion 7*b* of the gas quenching chamber 7 and the inlet portion 8*a* of the oil quenching chamber 8 which are provided in the side surface portions of the two chambers which face each other across the second conveying chamber 10 is provided between the gas quenching chamber 7 and the oil quenching chamber 8; inside the first conveying chamber 9, the thermally insulating up-and-down door (open-close door) 62 is provided for the outlet portion 6*b* of the temperature decrease chamber 6 which is provided in the side surface portion thereof that faces or is close to the gas quenching chamber 7; inside the first conveying chamber 9, the pressure-resisting up-and-down door (open-close door) 71 is provided for the inlet portion 7*a* of the gas quenching chamber 7 which is provided in the side surface thereof that faces or is close to the temperature decrease chamber 6; inside the second conveying chamber 10, the pressure-resisting up-and-down door (open-close door) 72 is provided for the outlet portion 7*b* of the gas quenching chamber 7 which is provided in the side surface portion thereof that faces or is close to the oil quenching chamber 8; and inside the second conveying chamber 10, the oil vapor-shutting-off up-and-down door (open-close door) 81 is provided for the inlet portion 8*a* of the oil quenching chamber 8 which is provided in the side surface thereof that faces or is close to the gas quenching chamber 7.

Having the foregoing construction, the continuous gas carburizing furnace 1 of this embodiment makes it possible to sufficiently secure air tightness of the interiors of the chambers, that is, even of the temperature decrease chamber 6, the gas quenching chamber 7 and the oil quenching chamber 8, which are different from each other in the interior conditions.

This will be more specifically explained. That is, the temperature decrease chamber 6 and the gas quenching chamber 7 disposed adjacent to each other need to have a thermal insulation function and a pressure resistance function, respectively. In the foregoing construction, since the thermally-insulating up-and-down door 62 for the temperature decrease chamber 6 and the pressure-resisting up-and-down door 71 for the gas quenching chamber 7 are provided in the space between the two chambers, both the thermal insulation function and the pressure resistance can be achieved and the air tightness of the temperature decrease chamber 6 and the gas quenching chamber 7 can be secured. Similarly, the gas quenching chamber 7 and the oil quenching chamber 8 disposed adjacent to each other need to have the pressure resistance function and an oil vapor tightness function, respectively. In the foregoing construction, since the pressure-resisting up-and-down door 72 for the gas quenching chamber 7 and the oil vapor-shutting-off up-and-down door 81 for the oil quenching chamber 8 are provided in the space between the two chambers, both the pressure resistance function and the oil vapor tightness function can be achieved and the air tightness of the gas quenching chamber 7 and the oil quenching chamber 8 can be secured.

Besides, in the continuous gas carburizing furnace 1 of this embodiment, the communication pathway 11 that provides communication between the interior of the first conveying chamber 9 and the interior of the second conveying chamber 10 is provided between the first conveying chamber 9 and the second conveying chamber 10.

By interlinking the first conveying chamber 9 and the second conveying chamber 10 simply via the communication pathway 11, the carburizing gas (CO gas) filling the first conveying chamber 9 is guided through the communication pathway 11 into the second conveying chamber 10, and in turn is supplied into the oil quenching chamber 8 every time the up-and-down door 81 is opened. Therefore, the amount of external air (oxygen) that flows into the oil quenching chamber 8 when the open-close door 82 is opened and closed is reduced due to the blockage by the carburizing gas (CO gas), so that the poor quality of the workpieces 50 resulting from the oxidation during the oil quenching process can be reduced by the low-cost construction.

Besides, in the continuous gas carburizing furnace 1 of this embodiment, the oil quenching chamber 8 is provided with the gas supply device 85 that introduces the carburizing gas or a nitrogen gas into the oil quenching chamber 8.

Having this construction, the continuous gas carburizing furnace 1 of this embodiment makes it possible to certainly fill the oil quenching chamber 8 with the carburizing gas (CO gas) or an inert gas (nitrogen gas). Therefore, the amount of external air (oxygen) that flows into the oil quenching chamber 8 as the open-close door 82 is opened and closed is reduced due to the blockage by the carburizing gas (CO gas), so that the poor quality of the workpieces 50 resulting from the oxidation during the oil quenching process can be more certainly reduced.

Besides, in the continuous gas carburizing furnace 1 of this embodiment, the temperature decrease chamber 6 is provided with the carburizing gas supply device (carburizing gas purge mechanism) 63 for restraining the reduction in the CO concentration in the temperature decrease chamber 6, and the carburizing gas supply device (carburizing gas purge mechanism) 63 supplies the carburizing gas into the temperature decrease chamber 6 after the pressure-resisting up-and-down door (open-close door) 71 provided for the inlet portion 7*a* of the gas quenching chamber 7 which is provided in the side surface portion thereof that faces or is close to the temperature decrease chamber 6 is opened.

In the continuous gas carburizing furnace 1 of this embodiment constructed as described above, the CO concentration in the atmosphere in the temperature decrease chamber 6 can be quickly increased from a reduced level resulting from the opening and closing movements of the up-and-down door 62 back to the normal level of CO concentration.

While some embodiments of the invention have been illustrated above, it is to be understood that the invention is not limited to details of the illustrated embodiments, but may be embodied with various changes, modifications or improvements, which may occur to those skilled in the art, without departing from the scope of the invention.

The invention claimed is:

1. A continuous gas carburizing furnace in which a plurality of steps are serially arranged in a line along a conveying direction of a workpiece, comprising:

a gas carburizing processing chamber in which a gas carburizing process is performed on the workpiece;

an oil quenching chamber in which oil quenching is performed on the workpiece; and a gas quenching chamber in which gas quenching is performed on the workpiece, wherein:

the gas carburizing processing chamber includes a temperature decrease chamber that lowers temperature of the workpiece that is heated by a gas carburizing process, and to which a carburizing gas is supplied;

the temperature decrease chamber, the gas quenching chamber and the oil quenching chamber are arranged sequentially in that order of mention from an upstream side to a downstream side in the conveying direction of the workpiece, and are adjacent to each other;

a first conveying chamber that covers a side surface portion of the temperature decrease chamber and a side surface portion of the gas quenching chamber which face each other is provided between the temperature decrease chamber and the gas quenching chamber;

a second conveying chamber that covers a side surface portion of the gas quenching chamber and a side surface portion of the oil quenching chamber which face each other is provided between the gas quenching chamber and the oil quenching chamber;

inside the first conveying chamber, a first open-close door for thermal insulation, in which a hole portion is provided, is provided for the side surface portion of the temperature decrease chamber which faces the gas quenching chamber;

inside the first conveying chamber, a second open-close door for pressure resistance is provided for the side surface portion of the gas quenching chamber which faces the temperature decrease chamber;

inside the second conveying chamber a third open-close door for pressure resistance is provided for the side surface portion of the gas quenching chamber which faces the oil quenching chamber;

inside the second conveying chamber, a fourth open-close door for oil vapor shield, in which a hole portion is provided, is provided for the side surface portion of the oil quenching chamber which faces the gas quenching chamber;

a communication pathway that provides communication between the first conveying chamber and the second conveying chamber is provided between the first conveying chamber and the second conveying chamber;

the carburizing gas supplied to the temperature decrease chamber flows into the first conveying chamber through the hole portion provided in the first open-close door for the side surface portion of the temperature decrease chamber which faces the gas quenching chamber;

the carburizing gas filling the first conveying chamber is guided into the second conveying chamber through the communication pathway; and the carburizing gas guided into the second conveying chamber is supplied into the oil quenching chamber through the hole portion provided in the fourth open-close door for the side surface portion of the oil quenching chamber which faces the gas quenching chamber.

2. The continuous gas carburizing furnace according to claim 1, wherein the oil quenching chamber is provided with a gas supply device arranged to introduce a carburizing gas or a nitrogen gas into the oil quenching chamber.

3. The continuous gas carburizing furnace according to claim 1, wherein:

the temperature decrease chamber is provided with a carburizing gas purge mechanism arranged to restrain decline of carbon monoxide concentration in the temperature decrease chamber; and the carburizing gas purge mechanism is arranged to supply a carburizing gas into the temperature decrease chamber after the second open-close door for pressure resistance provided for the side surface portion of the gas quenching chamber which faces the temperature decrease chamber is opened.

4. A continuous gas carburizing furnace in which a plurality of steps are serially arranged in a line along a conveying direction of a workpiece, comprising:

a gas carburizing processing chamber in which a gas carburizing process is performed on the workpiece;

an oil quenching chamber in which oil quenching is performed on the workpiece; and a gas quenching chamber in which gas quenching is performed on the workpiece, wherein:

the gas carburizing processing chamber includes a temperature decrease chamber that lowers temperature of the workpiece that is heated by a gas carburizing process, and to which a carburizing gas is supplied;

the temperature decrease chamber, the gas quenching chamber and the oil quenching chamber are arranged sequentially in that order of mention from an upstream side to a downstream side in the conveying direction of the workpiece, and are adjacent to each other;

a first conveying chamber that covers a side surface portion of the temperature decrease chamber and a side surface portion of the gas quenching chamber which face each other is provided between the temperature decrease chamber and the gas quenching chamber;

a second conveying chamber that covers a side surface portion of the gas quenching chamber and a side surface portion of the oil quenching chamber which face each other is provided between the gas quenching chamber and the oil quenching chamber;

inside the first conveying chamber, a first open-close door for thermal insulation is provided for the side surface portion of the temperature decrease chamber which faces the gas quenching chamber;

inside the first conveying chamber, a second open-close door for pressure resistance is provided for the side surface portion of the gas quenching chamber which faces the temperature decrease chamber;

inside the second conveying chamber, a third open-close door for pressure resistance is provided for the side surface portion of the gas quenching chamber which faces the oil quenching chamber;

inside the second conveying chamber, a fourth open-close door for oil vapor shield is provided for the side surface portion of the oil quenching chamber which faces the gas quenching chamber;

a communication pathway that provides communication between the first conveying chamber and the second conveying chamber is provided between the first conveying chamber and the second conveying chamber;

the carburizing gas supplied to the temperature decrease chamber flows into the first conveying chamber due to opening and closing movements of the first open-close door for the side surface portion of the temperature decrease chamber which faces the gas quenching chamber;

the carburizing gas filling the first conveying chamber is guided into the second conveying chamber through the communication pathway; and the carburizing gas guided into the second conveying chamber is supplied into the oil quenching chamber due to opening and closing movements of the fourth open-close door for the side surface portion of the oil quenching chamber which faces the gas quenching chamber.

5. The continuous gas carburizing furnace according to claim 4, wherein the oil quenching chamber is provided with a gas supply device arranged to introduce a carburizing gas or a nitrogen gas into the oil quenching chamber.

6. The continuous gas carburizing furnace according to claim 4, wherein:

the temperature decrease chamber is provided with a carburizing gas purge mechanism arranged to restrain decline of carbon monoxide concentration in the temperature decrease chamber; and the carburizing gas purge mechanism is arranged to supply a carburizing gas into the temperature decrease chamber after the second open-close door for pressure resistance provided for the side surface portion of the gas quenching chamber which faces the temperature decrease chamber is opened.

* * * * *